United States Patent [19]

Eilers

[11] 3,944,747

[45] Mar. 16, 1976

[54] MULTIPLE CHANNEL FM STEREO SYSTEM

[75] Inventor: Carl G. Eilers, Oak Park, Ill.

[73] Assignee: Zenith Radio Corporation, Chicago, Ill.

[22] Filed: Sept. 28, 1973

[21] Appl. No.: 401,926

Related U.S. Application Data

[63] Continuation-in-part of Ser. No. 283,464, Aug. 24, 1972, abandoned, which is a continuation-in-part of Ser. No. 190,008, Oct. 18, 1971, abandoned.

[52] U.S. Cl. ..... 179/15 BT

[51] Int. Cl.[2] ..... H04H 5/00

[58] Field of Search ..... 179/15 BT, 1 GQ

[56] References Cited

UNITED STATES PATENTS

| | | | |
|---|---|---|---|
| 3,679,832 | 7/1972 | Halpern | 179/15 BT |
| 3,708,623 | 1/1973 | Dorren | 179/15 BT |
| 3,754,099 | 8/1973 | Takaoka | 179/15 BT |
| 3,787,629 | 1/1974 | Limberg | 179/15 BT |
| 3,789,323 | 1/1974 | Anderson | 179/15 BT |

OTHER PUBLICATIONS

Quadrature Ambience With Reference Tone by Gerzon Radio–Electronics, Dec. 1970, pp. 52, 53, 58.

"Militplex Methods for FM Broadcast Transmission of Four-Channel Stereo Signals" by Halstead & Feldman, *Journal AES* Dec. 1970.

*Primary Examiner*—Douglas W. Olms

*Attorney, Agent, or Firm*—Cornelius J. O'Connor

[57] ABSTRACT

A transmitter or a receiver processes four-channel stereo frequency-modulation information. The information represents four audio signals A, B, C and D that correspond to sources respectively located at the left-front, right-front, left-rear and right-rear of a listening point. First and second sub-carrier signals $\omega_s$ and $\omega_{s2}$ both have frequencies substantially higher than the highest audio signal component. In one disclosed embodiment all of the different signals are combined to develop a signal having a carrier signal frequency that is modulated by double-sideband amplitude-modulated suppressed-carrier sub-carrier signals as expressed by the modulation function $$M(t) = K_1 (A+B+C+D) + K_2 (A-D) \cos\omega_s t + K_3 (B-C) \sin\omega_s t + K_4 [(A+D) - (B+C)] \cos\omega_{s2} t$$

where $K_1$ to $K_4$ are constants and t is time. An alternative system provides for single sideband transmission and reception of the sub-carrier $\omega_{s2}$ and places an SCA channel at the location of the missing sideband.

24 Claims, 23 Drawing Figures

FIG. 1
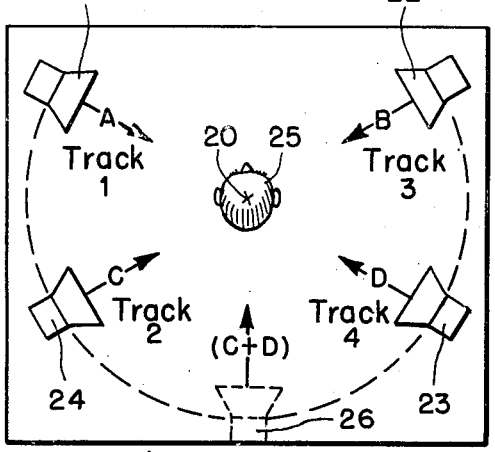
FIG. 2
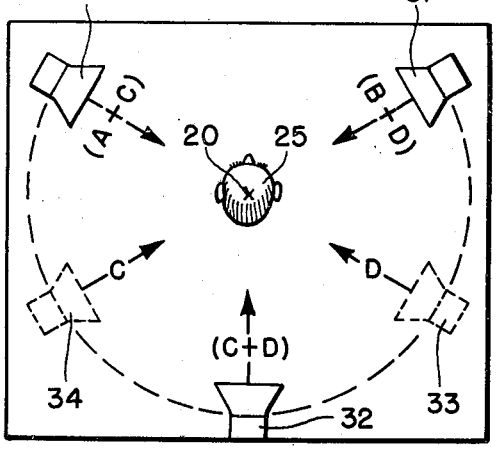
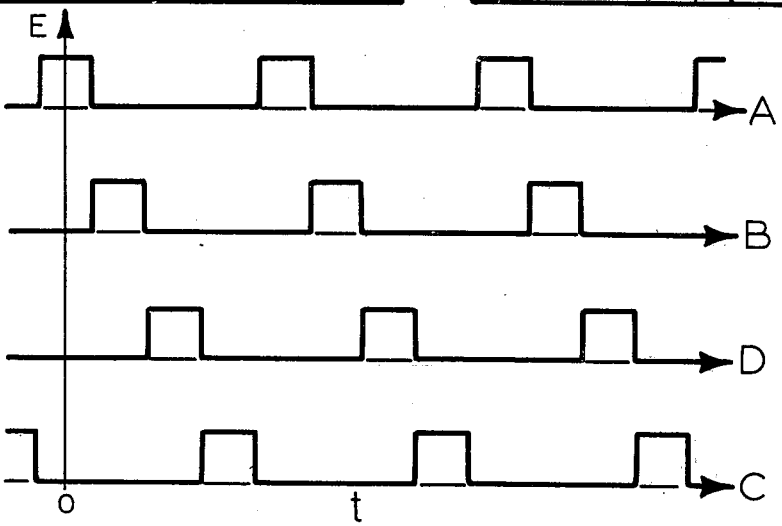
FIG. 4
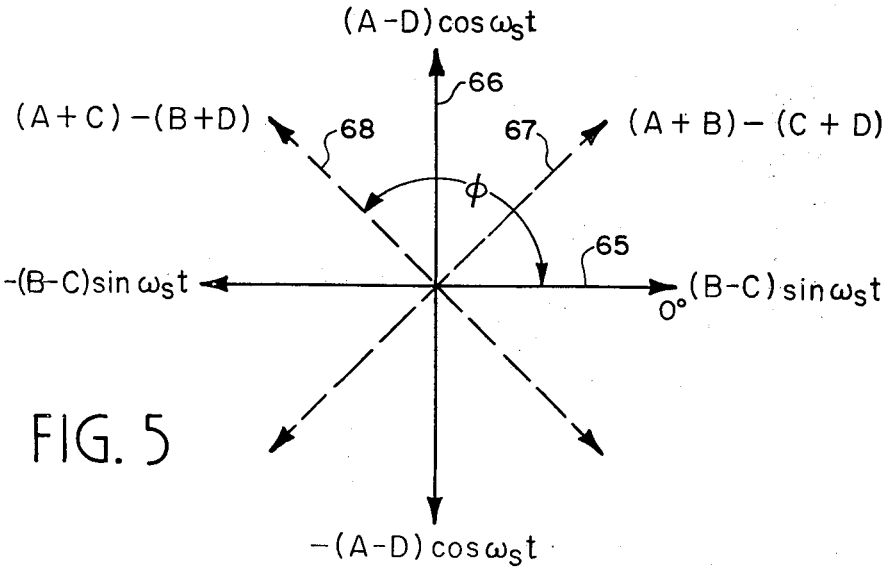
FIG. 5

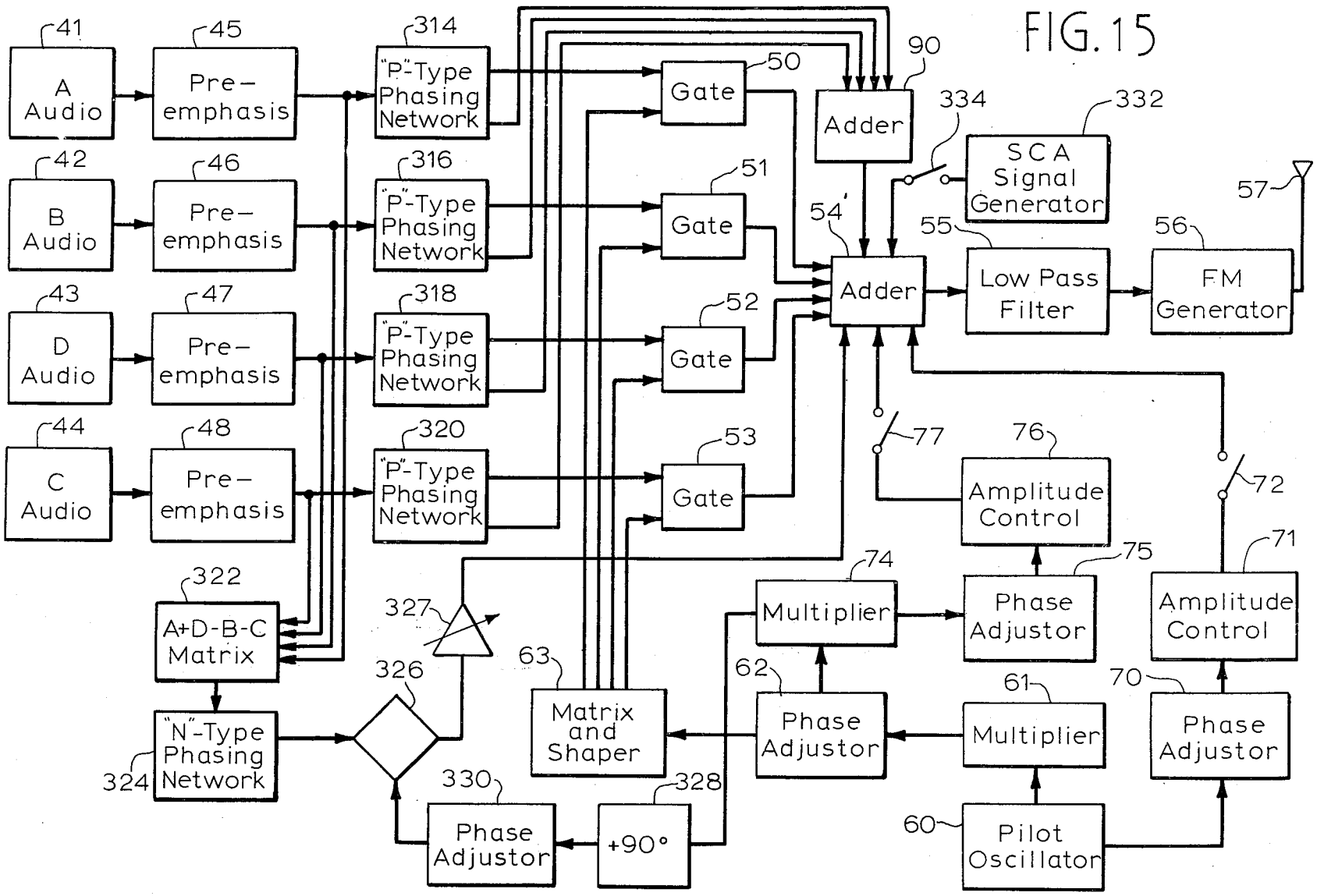
FIG. 15
A Audio
B Audio
D Audio
C Audio
Pre-emphasis
Pre-emphasis
Pre-emphasis
Pre-emphasis
"P"-Type Phasing Network
"P"-Type Phasing Network
"P"-Type Phasing Network
"P"-Type Phasing Network
Gate
Gate
Gate
Gate
Adder
Adder
SCA Signal Generator
Low Pass Filter
FM Generator
Amplitude Control
Amplitude Control
Phase Adjustor
Phase Adjustor
Phase Adjustor
Multiplier
Multiplier
Pilot Oscillator
Matrix and Shaper
+90°
Phase Adjustor
A+D-B-C Matrix
"N"-Type Phasing Network
41
42
43
44
45
46
47
48
50
51
52
53
54
55
56
57
60
61
62
63
70
71
72
74
75
76
77
90
314
316
318
320
322
324
326
327
328
330
332
334

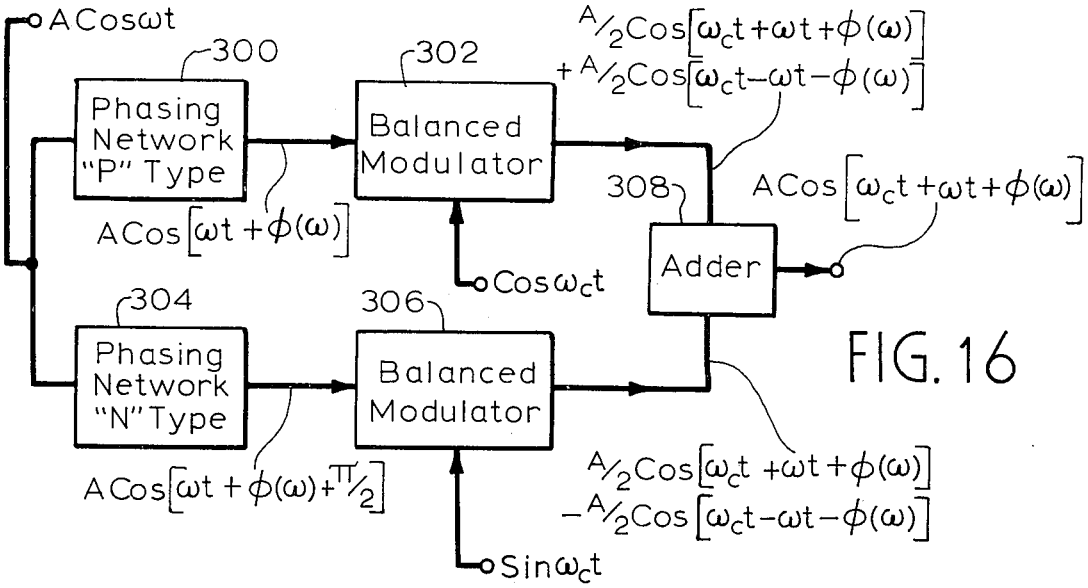
FIG. 16
FIG. 17
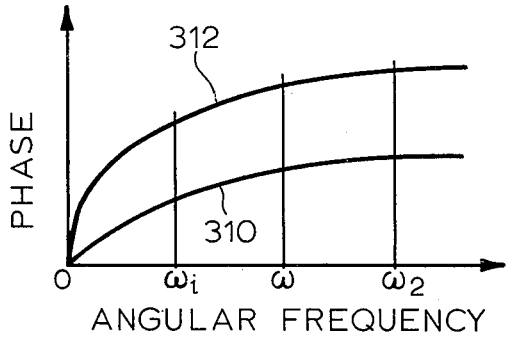
FIG. 17A
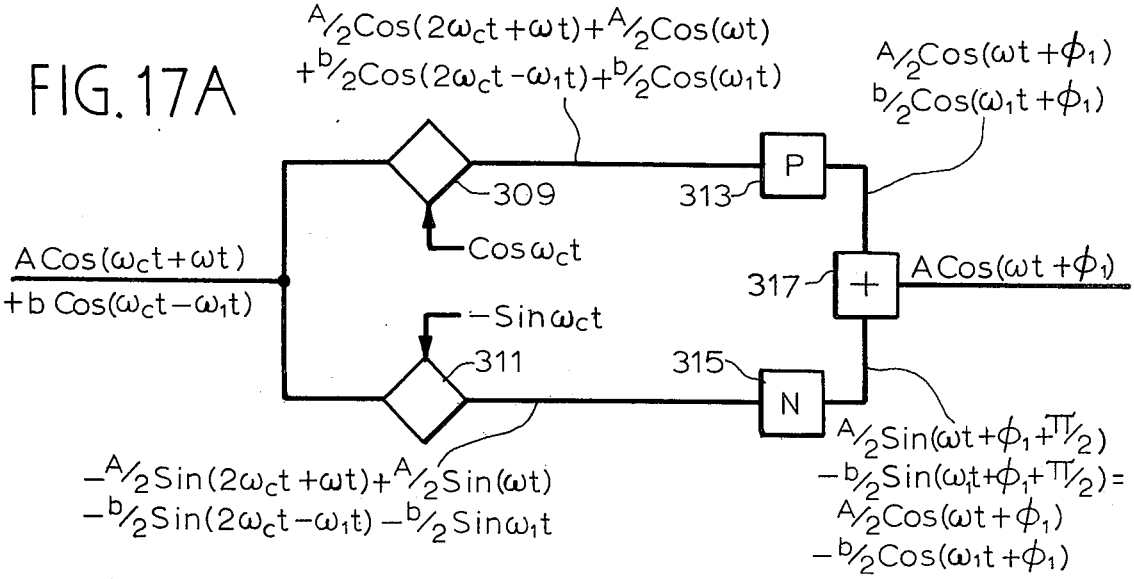

MULTIPLE CHANNEL FM STEREO SYSTEM

CROSS-REFERENCE TO RELATED APPLICATION

This application is a continuation-in-part of my copending application Ser. No. 283,464, filed Aug. 24, 1972, now abandoned which, in turn, is a continuation-in-part of my application Ser. No. 190,008, filed Oct. 18, 1971, now abandoned, both of which applications are assigned to the assignee of this application.

BACKGROUND OF THE INVENTION

The present invention relates to multiple-channel frequency-modulation stereo systems. More particularly, it pertains to methods and apparatus for encoding and decoding multiple channel stereo signals.

Present-day broadcast FM stereo features the transmission of a two-channel coherent stereo signal the modulation function of which may be represented:

$$M'(t) = K'(L+R) + K''(L-R)\sin\omega_s t, \qquad (1)$$

where $L$ represents a left-side audio signal, $R$ represents a right-side audio signal, $\omega_s$ is the frequency of a suppressed-carrier amplitude-modulated sub-carrier signal, $t$ is time, and $K'$ and $K''$ are constants. A two-channel stereo receiver responds to a stereo broadcast by demodulating the sum and difference audio terms and then matrixing those two terms in order to yield the fundamental left and right audio signals L and R. The same receiver will respond to a monaural FM broadcast by reproducing the same monaural audio signal in both of its output channels. On the other hand, a monaural FM receiver will respond to the two channel broadcast stereo signal by deriving only the sum term (L+R) as represented in equation (1) and reproducing an audio signal that represents the monaural program. The two-channel signal thus is fully compatible with the monaural signal so that a receiver properly designed for one also will receive the other. Further detailed discussion of the foregoing two-channel transmission system and exemplary disclosures of transmitters and receivers for use therewith will be found in U.S. Pat. Nos. 3,257,511—Adler et al.; 3,257,512—Eilers; 3,129,288—DeVries and 3,151,218—Dias et al., all assigned to the same assignee as the present application.

In the last few years, interest has been evident in tape-recording systems wherein a four-channel stereo signal is recorded on magnetic tape. Four different audio signals are individually recorded on four respective different tracks along the tape. The four different audio signals represent sources respectively located at the left-front, right-front, left-rear and right-rear of an originating point. By using four different pick-up and amplification systems together with four separate loudspeakers similarly distributed around a listening point, four-channel reproduction is obtained.

The advent of four-channel stereo recording and reproduction has naturally led to consideration of the desirability of transmitting and receiving four-channel stereo signals by radio. because two-channel stereo is now being broadcast by many FM transmitting stations, attention has been directed particularly to the possibility of utilizing broadcast stations in that category of service for the transmission of four-channel stereo in addition to, or instead of, the transmission of two-channel stereo or monaural signals. To accomplish this requires the development of a different overall transmission signal in order to accommodate the additional information components necessary to convey four separate channels. At the same time, it is desirable that any four-channel approach be fully compatible both with two-channel stereo and monaural, so that receiver obsolescence is avoided.

It is also desirable, from the standpoint of broadcast station ecomonics, that a commercial four-channel stereo system provide for an SCA (Subsidiary Communications Authoriztion) channel.

OBJECTS OF THE INVENTION

Accordingly, it is a general object of the present invention to provide a new and improved four-channel stereo FM broadcast system which is compatible with conventional two-channel and monaural broadcasting.

Another object of the present invention is to provide a four-channel stereo broadcast system in which the arrangement of the channels is consistent with that of present-day four-channel stereo recordings.

A further object of the present invention is to provide a compatible four-channel stereo broadcasting system in which bandwidth requirements are consistent with existing broadcast standards.

A related object of the present invention is to provide a stereo broadcasting system capable of permitting transmission and reception of either three-channel or four-channel stereo information.

It is yet another object to provide an improved four-channel FM stereo broadcast system which provides for an SCA channel.

Specific objects of the present invention include the provision of transmitters and receivers operable in broadcast systems meeting the preceding objectives.

BRIEF DESCRIPTION OF THE DRAWINGS

The features of the present invention which are believed to be novel are set forth with particularlity in the appended claims. The organization and manner of operation of the invention, together with further objects and advantages thereof, may best be understood by reference to the following description taken in conjunction with the accompanying drawings, in the several figures of which like reference numerals identify like elements, and in which:

FIG. 1 is a layout of a four-channel stereo-reproduction system;

FIG. 2 is a layout of a three-channel stereo-reproduction system;

FIG. 4 is a plot of switching waveforms preferably utilized in the system of FIG. 3;

FIG. 5 is a vector diagram illustrating phase relationships between different signal components produced by the transmitter of FIG. 3;

FIG. 15 is a block diagram of a four-channel stereo transmitter similar to the FIG. 3 transmitter but having specific provision for transmitting a four-channel stereo signal with an SCA (Subsidiary Communications Authorization) signal;

FIGS. 16, 17 and 17A are diagrams useful in understanding a "phasing" method of single sideband modulation or demodulation employed by the FIG. 15 transmitter;

DESCRIPTION OF THE PREFERRED EMBODIMENTS

Figure 3:
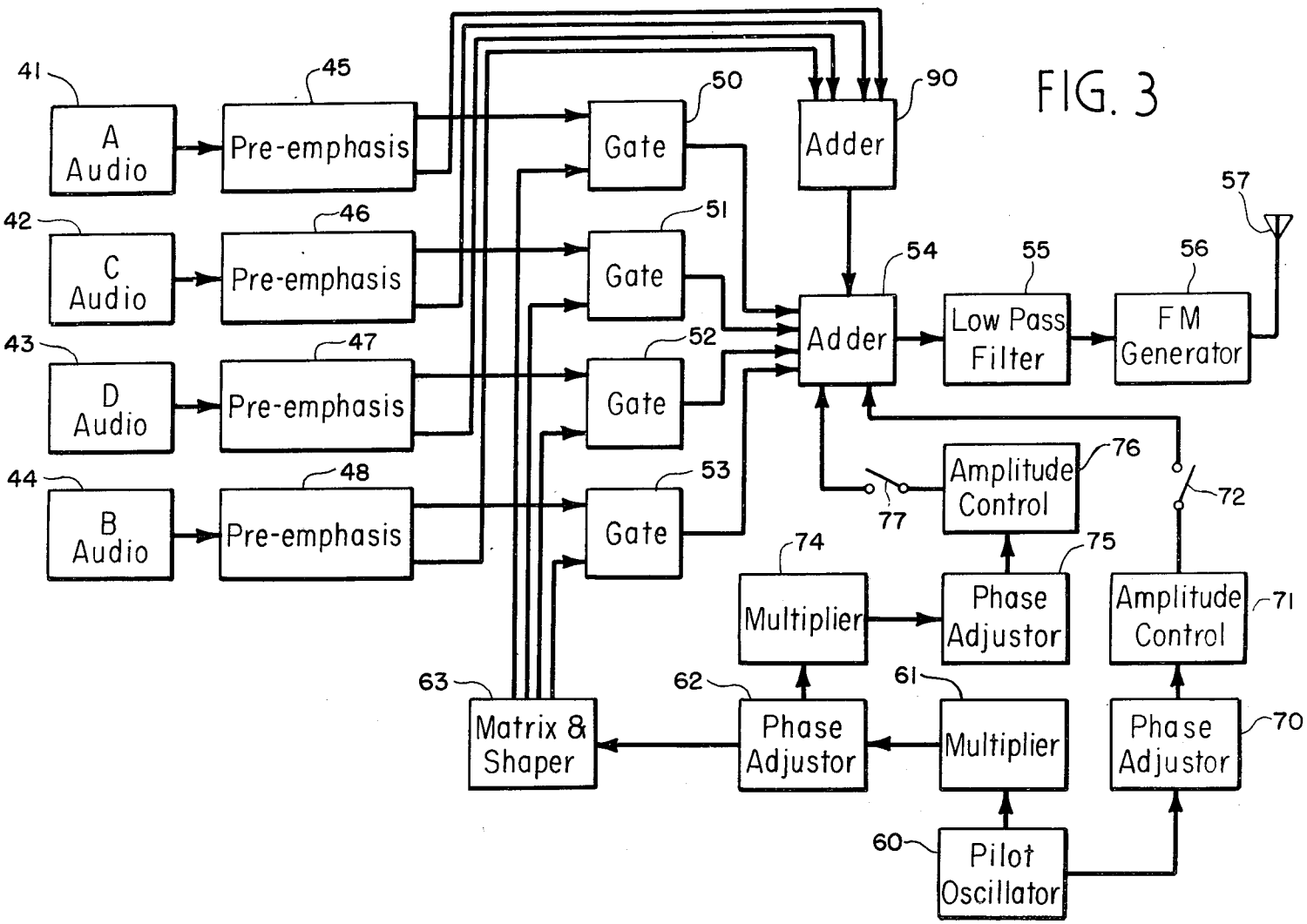
FIG. 3 is a block diagram of a four-channel FM stereo transmitter.

FIG. 1 illustrates a typical four-channel stereo listening area layout. Spaced generally around a circle surrounding a listening point 20 are a plurality of loudspeakers 21, 22, 23 and 24. Adopting nomenclature already somewhat standard in the tape recording industry, the four sound channels are designated A, B, D and C, respectively. The four different channels then correspond to track numbers 1, 3, 4 and 2, also respectively. With a listener 25 located in the vicinity of point 20 and, as illustrated, facing in a direction so that channel A is at his left-front, channels B, D and C are then at his right-front, right-rear and left-rear, respectively.

With the audio signals in the four channels having originally been picked up by a correspondingly-disposed plurality of four microphones arranged in a circle around the source of sound, listener 25 finds himself encircled with sound in a manner characteristic of four-channel stereo reproduction. Utilizing the correlation of the audio signals as between channels C and D, listener 25 senses an apparent or phantom source to his rear. That is, to the listener it is as if there were a source 26, as indicated by dashed lines in FIG. 1, positioned behind the listener and consisting of the correlated components of channels C and D.

FIG. 1, then, suggests one general manner of transmitting and/or reproducing signals in but three channels in order to achieve what, to the listener, is an effect of four-channel stereo. That is, the three separate channels necessary to be broadcast or recorded could be (A), (B) and (C+D). One approach to broadcasting such a combination of signals is to formulate a signal having a modulation function like that of equation (1) in the introduction and wherein A becomes L and B becomes R. In addition, the combined audio signal (C+D) is impressed upon the sub-carrier in phase quadrature to the (L–R) term; that is, equation (1) would then include an additional term: $(C+D)\cos\omega_s t$.

FIG. 2 is an improved loudspeakers layout for the reproduction of four-channel stereo information from a three-channel system of recording or broadcasting. As will become apparent from a consideration of systems yet to be discussed, the arrangement of FIG. 2 permits the use of broadcast systems wherein compatibility is obtained. In this arrangement, a loudspeaker 30 to the left-front of listening point 20 and listener 25 reproduces (A+C) audio signals. At the right-front of listener 25 is a loudspeaker 31 that produces (B+D) audio signals. Finally, a loudspeaker 32, located to the rear of listener 25 reproduces (C+D) audio signals. Again utilizing only fully correlated signal components, a phantom source 33, productive of audio signal D, appears to the listener as if located adjacent to his right-rear. Similarly, the listener "hears" an audio signal C arriving from a phantom source 34 located adjacent to his left-rear. This occurs because of the arrival at his right ear of D signal information from both loudspeakers 31 and 32 which are equally spaced around the circular arrangement from the position of phantom source 33. Similarly, the listener's left ear derives the combined C information present in both loudspeakers 30 and 32.

Utilizing the arrangement of FIG. 2 for the reproduction of signals recorded on magnetic tape, it will be apparent that only three tracks of recorded signals are necessary on the tape itself in order to reproduce a form of four-channel stereo in response to the pickup of four separate signal components at locations correspondingly spaced around the original sound source. In that case, the four signals originally picked up would be combined into the three signals (A+C), (B+D) and (C+D) before recording. Analogously, the three signals so combined might be interrelated into a modulation function for transmission by radio in a known multiplex transmission technique such as one of the numerous approaches presently in use for telemetry or by means of modification of the current two-channel stereo broadcast signal in the manner discussed above with respect to FIG. 1. Particularly for the purpose of FM stereo broadcasting, however, a four-channel FM carrier modulation function of a kind presently to be described is preferred because of compatibility with existing FM broadcast modes of transmission while at the same time permitting a choice of either four-channel stereo reproduction as depicted in FIG. 1 or three-channel stereo reproduction as depicted in FIG. 2.

To those ends, the transmitter of FIG. 3 includes four distinct audio signal sources 41, 42, 43, and 44, respectively producing audio signals A, C, D, and B. Those signals again represent pick-up points located generally in a circle around an original sound source in positions corresponding to those of the loudspeakers productive of the same respective audio signals with reference to listening point 20 in FIG. 1. Alternatively, audio sources 41–44 may be corresponding pickup apparatus of a four-channel record mechanism such as a four-track tape recorder as described above. In that case, of course, the information stored in the four tracks originally is derived from a plurality of sound pickups arranged at locations corresponding to those of FIG. 1.

Audio sources 41–44 are individually coupled to a corresponding plurality of pre-emphasis networks 45–48 in order to derive an improved signal-to-noise ratio as well understood in the art. That is, the low-frequency portion of each audio signal, relative to the high-frequency components thereof, is attenuated. From the pre-emphasis networks, each of the audio signals then is individually fed to a respective one of gates 50, 51, 52 and 53. When gated on, the different audio signals all are coupled into an adder network 54 in which the different gated audio signals are combined and then fed through a low-pass filter 55 to frequency modulate a main carrier developed by a generator 56 which feeds a composite broadcast signal to an antenna 57.

A pilot or control signal developed by an oscillator 60 is doubled in frequency by a frequency multiplier 61 and fed through a phase adjustor 62 to a matrix and pulse shaper 63. Particularly in the interest of achieving compatibility with current broadcast standards for two-channel FM stereo broadcasting, the pilot signal from oscillator 60 is assigned a frequency of 19kHz and multiplier 61 adapted to double the frequency of this signal. Consequently, the frequency $\omega_s$ of the signal fed to matrix and pulse shaper 63 is 38kHz. The function of matrix and pulse shaper 63 is to develop four different pulse trains, one for each different one of gates 50–53. The pulse trains are interrelated in time as shown in FIG. 4 wherein the four different pulse trains are labelled A, B, D and C in respective correspondence to their application to gates 50, 51, 52 and 53. In more detail, matrix and pulse shaper 63 thus develops a total of four switching waveforms which have respective Fourier series expansions as follows:

Channel A: $\frac{1}{4} + 1/\pi\,(\sqrt{2}\cos\omega_s t + \cos 2\omega_s t + \ldots)$,
Channel B: $\frac{1}{4} + 1/\pi\,(\sqrt{2}\sin\omega_s t - \cos 2\omega_s t + \ldots)$,
Channel D: $\frac{1}{4} - 1/\pi\,(\sqrt{2}\cos\omega_s t + \cos 2\omega_s t + \ldots)$,
and
Channel C: $\frac{1}{4} - 1/\pi\,(\sqrt{2}\sin\omega_s t - \cos 2\omega_s t + \ldots)$.

Combining the audio signals produced in each channel by their respective switching waveforms, and gathering terms, the composite signal in adder 54 becomes:

$$M(t) = K_1(A+B+C+D) + K_2(A-D)\cos\omega_s t + K_3(B-C)\sin\omega_s t + K_4[(A+D)-(C+B)]\cos\omega_{s2} t + \ldots, \quad (2)$$

where, $t$ is time and $K_1$, $K_2$, $K_3$ and $K_4$ are 1, $\sqrt{2}$, $\sqrt{2}$, and 1, respectively. In this case, $\omega_{s2} = 2\omega_s$. It will thus be seen that the composite signal contains a main channel which is the sum of all four audio channels, the difference between audio channels A and D modulated on an in-phase sub-carrier, a quadrature sub-carrier modulated by the difference between audio chanels B and C and a term in the form of a second harmonic of the basic sub-carrier and which is modulated by the difference between the sum of audio channels A and D and the sum of audio channels C and B. Higher order terms of the Fourier expansion also are present but need not be utilized.

FIG. 5 is a phasor diagram showing the in-phase and quadrature sub-carrier components. Assigning zero degrees as the phase of a vector 65, representing the (B−C) sub-carrier component, the (A−D) sub-carrier component necessarily appears at a position displaced by 90° as indicated by a vector 66. By detecting along the 45° axis as indicated by a vector 67, a component may be derived which, ignoring magnitudes, is the difference between the sum of the front channels and the sum of the rear channels, thusly (A+B)−(C+D). B). On the 135° axis as indicated by a vector 68, the quantity (A+C)−(B+C) may be detected; this is the difference between the sum of the left-front and left-rear channels and the sum of the right-front and right-rear channels.

For compatibility so that a conventional two-channel FM stereo receiver may properly operate upon such a signal, that receiver must be able to detect the combination of the two left-hand channels as the left signal (L) and the combination of the two right-hand channels as the right signal (R). To that end, a 19kHz pilot carrier $K_5S''$ also is transmitted, and its phase is adjusted so that its second harmonic has a phase corresponding to the 135° axis of vector 68. The conventional two-channel receiver derives the quantity (A+B+C+D) from the main carrier and the quantity (A+C)−(B+D) from the sub-carrier. Its additive matrix then sums those two quantities to provide an (A+C) signal which constitutes the left (L) two-channel stereo signal. Analogously, its subtractive matrix produces the difference between the two derived quantities which is of the form (B+D) that constitutes the right (R) signal. Since all four of the audio signals are represented in the modulation component (A+B+C+D) upon the main carrier, it is readily apparent that a conventional monophonic FM receiver will appropriately derive and reproduce a compatible monaural signal. Thus, from a qualitative standpoint the modulation function of equation (2) is arranged for compatibility as between monaural, two-channel and four-channel stereo reception.

The above analysis of the manner in which a two-channel stereo receiver responds compatibly to the four-channel modulation function of equation (2) also reveals that a particular sequence of switching between the different channels must be employed. As specifically indicated in FIG. 4, the sequence will be observed, by reference again to FIG. 1, to be in a clockwise direction around listening point 20. Alternatively, the switching sequence may be in the opposite or counter-clockwise direction or in a zig-zag pattern as left-front to left-rear to right-front to right-rear. In any event, satisfaction of the compatibility requirement requires that two adjacent time samples be left-channel samples or right-channel samples.

As indicated, a monophonic receiver responds simply to the main-carrier modulation to reproduce a signal of the form (A+B+C+D), the first term of equation (2). A two-channel stereo receiver derives and matrixes both that main-channel modulation term and the audio information represented by vector 68 in FIG. 5. Accordingly, the arithmetical operations performed by a two-channel receiver may be as follows:

$$(A+B+C+D) + (A+C) - 2(A+C), \text{ and}$$
$$(A+B+C+D) - (A+C) + (B+D) = 2(B+D). \quad (3)$$

For three-channel reception, in addition to the already described components necessary to the reception of a two-channel stereo signal, a third signal component is included which is the sum of the left-rear and right-rear channels. With reference again to equation (2), it will be seen that this is achieved by the provision, in addition to the main channel signal represented by the first term, of both the in-phase and quadrature sub-carrier components represented by the second and third terms. That is, a complete three-channel stereo modulation function is represented by the first three terms of equation (2) and, for the purpose of transmitting only a three-channel stereo broadcast, the fourth term of equation (2) may be omitted. This particular form of three-channel composite signal results in an interleaving of the spectral energy in the different signal components in a manner analogous to the manner of spectral interleaving as described in the aforesaid Adler et al patent for the case of the two-channel signal. Moreover, a standard SCA background channel also may be transmitted at 67kHz as permitted under present commercial broadcast standards without any signal degradation. In addition to the main channel modulation, the three channel receiver than derives the audio signal information along the 45° and 135° axes as represented by vectors 67 and 68 in FIG. 5. The three reproduction signals as represented in FIG. 2 may then be derived by arranging the receiver to perform the following arithmetical operations:

$$(A+B+C+D) + (A+C) - (B+D) = 2(A+C),$$
$$(A+B+C+D) - (A+C) + (B+D) = 2(B+D), \text{ and}$$
$$(A+B+C+D) - (A+B) + (C+D) = 2(C+D). \quad (4)$$

It is then for the purpose of also permitting four-channel reception from the same composite signal that a still additional quantity of information is included within the modulation function of equation (2). While an equivalent component may be utilized, that added quantity of information is contained in the fourth term of equation (2) which preferably involves a second harmonic of the second term of the same equation. Consequently, a four-channel receiver responds to the composite modulation function by deriving the (B–C) and (A–D) signal components as represented at vectors 65 and 66 in FIG. 5, the same main-channel component (A+B+C+D) as before and also the second harmonic component modulation (A+D) – (B+C). The finally desired four separate audio stereo signals may then be derived in a four-channel receiver by matrixing to perform the following arithmetical operations:

$$(A+B+C+D) + 2(A-D) + (A+D) - (C+B) = 4A,$$
$$(A+B+C+D) + 2(B-C) + (C+B) - (A+D) = 4B,$$
$$(A+B+C+D) - 2(B-C) + (C+B) - (A+D) = 4C, \text{ and}$$
$$(A+B+C+D) - 2(A-D) + (A+D) - (C+B) = 4D.$$

Accordingly, it is now evident that the complete modulation function represented by equation (2) permits appropriate reception by any of monaural, two-channel, three-channel or four-channel stereo receivers. At the same time, by omitting the final term, the same modulation function may be utilized for the purpose of compatibly broadcasting a three-channel stereo signal.

For clarity of understanding, it should be noted that, whenever capital letters have been used to indicate audio signals in the above equations, they are but shorthand representations for the full audio function. That is, the A audio component, for example, would more completely be represented by the expression $A_M \cos\omega_A t$. However, it is not necessary to an understanding of the present invention to complicate the relationship additionally by actually including such a full statement in each equation.

While any receiver might be self-generative of the sub-carrier signals necessary to derive the sub-carrier modulation information, it is of course desirable that a pilot signal, as already mentioned, be transmitted along with the remainder of the broadcast information. Accordingly, the transmitter of FIG. 3 feeds a portion of the reference signal developed by oscillator 60 through a phase adjustor 70, an amplitude control 71 and a switch 72 to adder 54 for inclusion in the ultimate composite signal. Consistent with current two-channel stereo broadcast standards, amplitude control 71 is utilized to obtain a pilot modulation of between 8 and 10 percent. Phase adjuster 70, of course, is utilized to properly locate the pilot phase relative to the sub-carrier phases as represented in FIG. 5. Switch 72 is closed only during the broadcasting of stereo information so as to enable the use of receiver circuitry selectively responsive and indicative as between monaural and stereo operations.

In a similar manner, the once-doubled pilot signal from phase adjuster 62 is fed through a frequency multiplier 74, a phase adjuster 75, another amplitude control 76 and another switch 77 to adder 54. Multiplier 74 again doubles the pilot signal so that a 76 kHz second pilot signal also is transmitted as part of the composite modulation function. Switch 77 is closed only during the transmission of four-channel stereo information so as to permit the receiver to be selectively responsive to and indicative of the receipt of four-channel signals. Amplitude control 76 is employed to adjust the modulation percentage of the second harmonic pilot signal as desired or required by broadcast standards; this percentage again may be of the order of 8–10 percent.

Where it also is contemplated sometimes to broadcast only three-channel stereo information, a still-different and additional pilot signal may also be fed to adder 54 so as to provide a receiver the means to distinguish between three-channel and four-channel broadcasting as well as between three-channel and two-channel broadcasting. For example, that still additional pilot signal could be assigned a frequency of 38 kHz in the system described.

Figures 6, 7:
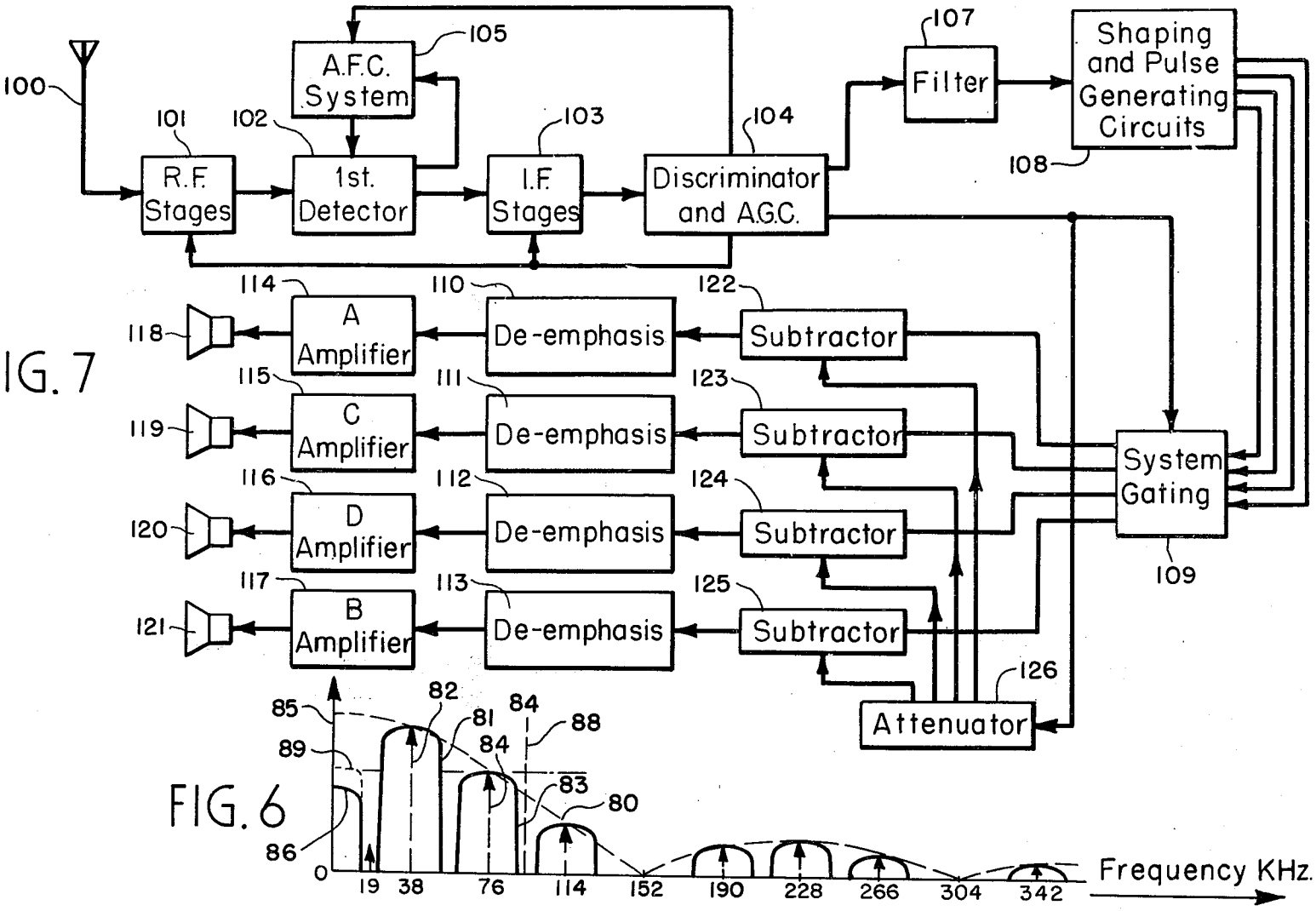
FIG. 6 is a spectral diagram of energy present in the signal developed by the transmitter of FIG. 3.
FIG. 7 is a block diagram of a four-channel stereo FM receiver capable of reproducing the signal information present in the signal transmitted from the apparatus of FIG. 3.

As has been shown, a key function in the transmitter of FIG. 3 is that of operating upon the four different audio signals in order sequentially to gate different ones of those signals to the combining means represented by adder 54 in a manner so as to produce the sub-carrier signals represented in the modulation function of equation (2). FIG. 6 depicts the resultant spectral response of this process as applied to one channel only. Since result is basically a Fourier series expansion of a rectangular wave, the envelope amplitude as represented by dashed line 80 defines a $(\sin x)/x$ function. With each of the spectral components being modulated by an audio signal, which occurs in the process of gating the different audio signals on and off, further spectral components are introduced as audio sidebands around each fundamental spectral component of the rectangular wave. With a switching or gating signal of 38 kHz as employed in FIG. 3, the fundamental spectral components occur at 38 kHz, 76 kHz, 114 kHz and at each successive higher harmonic of 38 kHz within additional lobes of envelope 80 each of successively lower amplitude.

Thus, envelope 81 represents the audio sidebands of a suppressed sub-carrier 82 located at 38 kHz. The correlated information within the audio sidebands represented by envelope 81 is that of the second and third terms of equation (2). A similar envelope 83 centered about a suppressed sub-carrier 84 at 76 kHz represents the audio information contained in the fourth term of equation (2). At the same time, the main channel 85 is modulated by a function representative of the first term of equation (2) and indicated by envelope 86 in FIG. 6. Insofar as the four-channel stereo information is concerned, all audio information contained in the sidebands attendant to the fundamental spectral component harmonics of a frequency higher than 76 kHz are redundant. Consequently, the spectral energy above envelope 83 preferably is truncated, as indicated by vertical dashed line 88, by means of attenuation in low-pass filter 55 of FIG. 3.

As indicated in FIG. 6, both the 38 kHz and 76 kHz sub-carriers are double-sideband amplitude modulated. Further, it will be noted that the audio modulating coefficient of each of the three sub-carrrier terms in equation (2) is a difference between two fundamental audio quantities. Each such term is a mathematical representation of the amplitude modulation of a carrier wherein the carrier itself is suppressed. That is, when the modulation vanishes the multiplying coefficient is zero as a result of which the carrier also vanishes. With a maximum audio modulating frequency of 15 kHz for each different signal component, it will be observed that the minimum channel width required for the first sub-carrier bands is 38 kHz ± 15 kHz, or from 23 kHz to 53 kHz. Similarly, the minimum channel width required for the second or harmonic sub-carrier sideband is from 61 to 91 kHz. Thus, the spectrum preferably is cut off between 91 and 99 kHz.

Observation of the composite signal by use of an oscilloscope reveals that, ignoring the small effect of the pilot sub-carriers, maximum peak-to-peak amplitude of the composite modulation function is no greater than the maximum of any of the four terms in equation (2) when coefficients $K_1$, $K_2$, $K_3$ and $K_4$ are suitably chosen. Such inspection shows that the main channel or firs term has a maximum peak-to-peak amplitude that is four times that of any of the individual audio signals alone. At the same time, it may be observed that the peak-to-peak amplitude of the composite of the main and the sub-carrier terms may be equal to or less than the maximum peak-to-peak amplitude of the main channel wave-form. Consequently, the FM generator may be fully modulated with the main channel audio of the first term of equation (2) and then also fully modulated with a composite term comprising the main and all three sub-carrier terms without having to reduce the modulation percentage for any component as applied to the radiated carrier. This property, called interleaving, is directly related to the manner of time-division multiplexing of the different audio components. It also is related to the fact that there is correlation existing between the different modulation components. Moreover, the same interleaving property also is obtained when, instead of the use of actual time-sequence gating as in FIG. 3, a more direct frequency-division approach is utilized to form the broadcast composite signal.

As so far presented, it has been shown by use of a multiplexing approach that the information contained within the modulation function of equation (2) permits compatibility as between the several different stereo modes in terms of just what information is received. However, for complete compatibility in all respects, it is also necessary to correlate properly the amplitude of each of the different signal components transmitted or received as part of the overall modulation function and as represented by the different terms. That is, there should be compatibility in the sense that, for example, a monaural receiver, other things being the same, will respond equally either to a monaural broadcast or to a four-channnel stereo broadcast. This requires that the different constants $K_1$ to $K_4$ in equation (2) be appropriately weighted. With direct sequential multiplexing as discussed with respect to FIG. 4, for a value of $K_1$ of 1/4, $K_2$ and $K_3$ are $\sqrt{2}/\pi$ and $K_4$ is $1/\pi$. These differences in amplitude are illustrated by the differences in height of the different envelopes 81, 83 and 86 in FIG. 6. For quantitative compatibility as between the different stereo modes and monophonic reception, it is, however, necessary that the constants in equation (2) be adjusted. To this end, the amplitude of the main channel modulation is augmented or raised, as indicated by envelope 89, to equal that of the amplitude of the sidebands on the second harmonic sub-carrier as represented by envelope 83. That is, $K_1$ is adjusted to become $1/\pi$, with $K_2$ and $K_3$ still being $\sqrt{2}/\pi$ and $K_4$ still being $1/\pi$, and with 100 percent modulation, constants $K_1$–$K_4$ become 1, $\sqrt{2}$, $\sqrt{2}$, and 1, respectively. This is accomplished in the transmitter of FIG. 3 by feeding a portion of each of the original audio signals to an adder 90 which then inserts an additional fraction of the main channel signal (A+B+C+D) into the composite modulation envelope by means of summation in adder 54.

The foregoing coefficient adjustment to achieve quantitative compatibility may be further understood by noting that, when two adjacent time slots are transmitted, the 38 kHz components are in quadrature with each other. Because of their $\sqrt{2}$ coefficient term, they add vectorially to produce a unity coefficient term as required for two-channel compatibility. Under this same condition, the second harmonic component vanishes. For the case, then, when only one channel is being broadcast, the main channel contribution is $1/\pi$ of the total, the 38 kHz is $\sqrt{2}/\pi$ of the total and the second harmonic component is $1/\pi$ of the total. Recognizing that full modulation in this situation is $4/\pi$, it may also be noted that, for this condition, the transmitter is being under modulated. Viewing the necessary coefficient adjustment in another light, reference may be made to the above equations for the four switching waveforms which were combined to yield equation (2). The adjustment is that of replacing the ¼ term by a $1/\pi$ term so as to be equal to the coefficient of the second harmonic term in those waveforms.

FIG. 7 depicts a time-multiplex receiver for reciprocally gating the different ones of the signal components from the transmission signal received from a transmitter such as that of FIG. 3, while demodulating the audio signal components from the different sub-carrier signals. Thus, the tranmission signal intercepted by an antenna 100 is received by one or more radio-frequency (RF) stages 101, converted to an intermediate frequency by a first detector 102, amplified in one or more intermediate-frequency (IF) stages 103 and fed to a discriminator and automatic-gain-control (AGC) network 104. In a conventional manner, the AGC portion of network 104 is utilized to develop a control signal that is fed back to govern the gain of stages 101 and 103 and hence insure the supply of a constant-amplitude signal to the discriminator. Similarly, an AFC system 105 compares the precise frequency of the intermediate-frequency carrier with the frequency of the local oscillator signal in detector 102 for the purpose of accurately fixing the response of the detector with respect to the frequency of the received broadcast signal.

When receiving a four-channel stereo broadcast, the signal available at the output of the discriminator in network 104 is the modulation function of equation (2) together with at least the pilot signal $K_5S''$. Recalling that the transmitter of FIG. 3 develops the modulation function by repetitively gating the four different primary audio signals sequentially into the total composite signal, the receiver in FIG. 7 for the four-channel stereo signal is constructed to operate in a manner which basically is the reciprocal of the manner of operation of the transmitter. That is, the modulation function from network 104 is sampled by four trains of pulses like those in FIG. 4 in order directly to develop the four different audio output signals A, C, D and B. The rate of sampling is the same as the rate of sequencing at the transmitter, in this case 38 kHz, and it is appropriate, therefore, to utilize the second harmonic of the 19 kHz pilot signal for the purpose of timing the receiver sampling rate. The receiver of FIG. 7, then, includes a filter 107 selective of the 19 kHz pilot signal and followed by shaping and pulse generating circuits 108 which develop the four trains of pulses that are fed to a gating system 109. In response to the timing provided by those pulse trains, gating system 109 then acts to sample the composite modulation function fed to it from network 104 in time corresponding with the original time sequencing at the transmitter. Ignoring for a moment a certain desired correction, the resulting four separate audio signals are fed individually to respective de-emphasis networks 110, 111, 112 and 113 that operate upon the audio signals reciprocally to the operation of pre-emphasis networks 45, 46, 47 and 48 in the transmitter of FIG. 3, this operation, as such, being entirely conventional. After de-emphasis, the four different audio signals are amplified in respective amplifiers 114, 115 116 and 117 following which the audio signals are fed individually to respective different loudspeakers 118, 119, 120 and 121.

By sampling with rectangular waves of the form shown in FIG. 4, a quantitative error in reproduction is encountered as between the different audio quantities. This is reciprocally analogous to the error compensated in the transmitter of FIG. 3 by use of adder 90. To the end of equalizing that sampling error in the receiver of FIG. 7, each of the four sampled audio signals is individually fed to its de-emphasis network through a respective one of subtractors 122, 123, 124 and 125. Each subtractor is fed a portion of the main channel audio component (A+B+C+D) derived from network 104 by an attenuator 126. As will be described in more detail in connection with the alternative receiver of FIG. 11, the modified signal from attenuator 126 is of the form $(1-2/\pi)$ (A+B+C+D).

Figure 8:
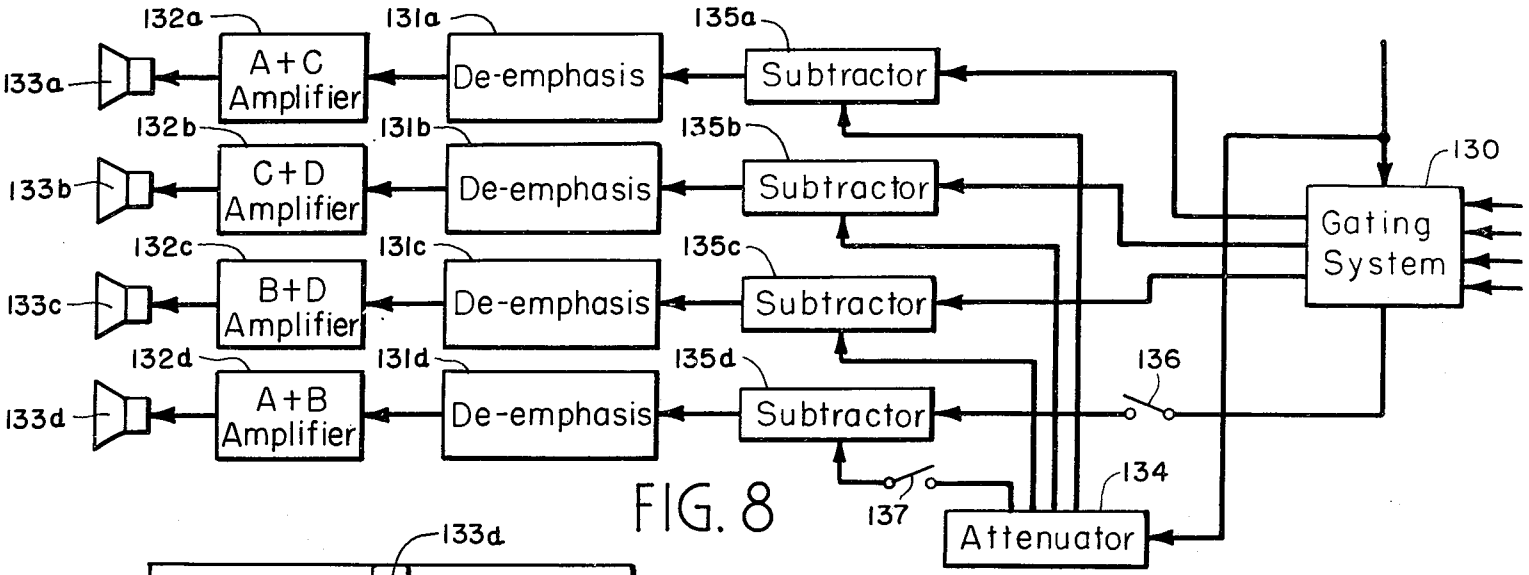
FIG. 8 is a block diagram of a three-channel or four-channel stereo receiver responsive to a signal of a kind developed by a modified form of the transmitter in FIG. 3.
Figure 9:
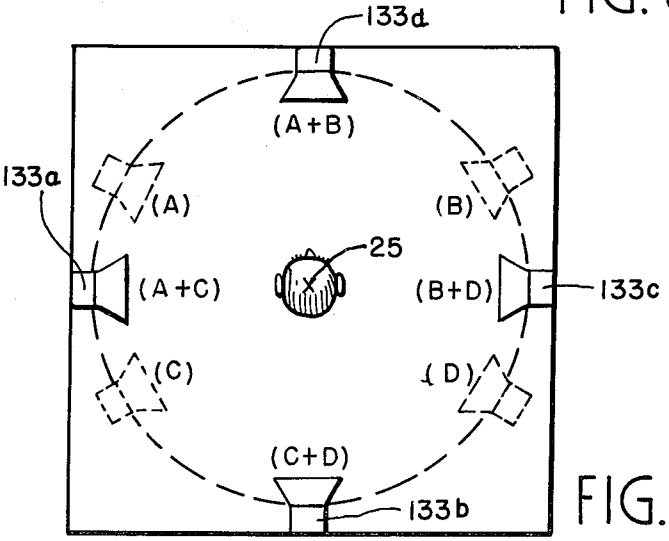
FIGS. 9 and 10 are alternative layouts of stereo-reproduction systems.
Figure 10:
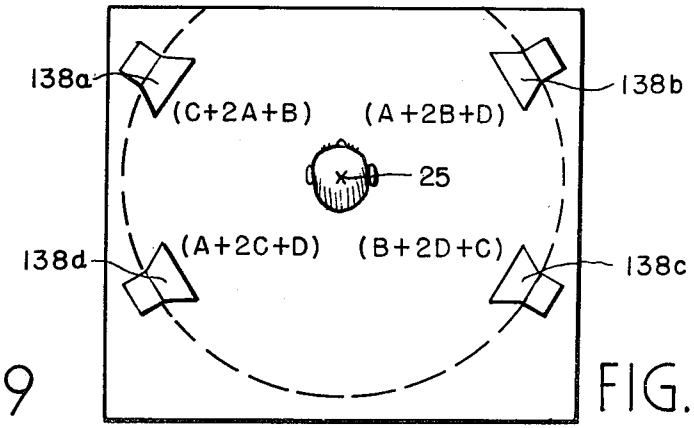

Modification of the receiver of FIG. 7 in a manner to be discussed with respect to FIG. 8 enables obtaining three or four fundamental output audio signals such that an acoustic effect of four-channel reproduction can be achieved in the manner of FIGS. 2, 9 or 10. In this case, filter 107 and shaping circuits 108 serve to produce trains of sampling pulses of the form used in FIG. 7, the contributions from two adjacent time samples effecting a 45° phase shift to effect sampling or demultiplexing along the axes represented by vectors 67 and 68 in FIG. 5. As in the case of FIG. 7, it still is necessary to modify each of the resulting audio signals in order to compensate or equalize for the characteristics of the rectangular wave de-multiplexing process and thus obtain cleanly separated audio components.

Accordingly, FIG. 8 includes a gating system 130 which receives the composite modulation function from the discriminator of network 104 while at the same time receiving sampling pulses of the form depicted in FIG. 4. In a first mode of operation, the audio samples obtained are in the form represented by equations (4) so as to yield the primary three-channel stereo signals (A+C), C+D) and (B+D). These latter signals are then individually fed through respective de-emphasis networks 131*a*, 131*b* and 131*c* and respective amplifiers 132*a*, 132*b* and 132*c* to corresponding loudspeakers 133*a*, 133*b* and 133*c*. Again for the purpose of equalization, a portion of the main channel component (A+B+C+D) is obtained from an attenuator 134 and deducted from the signal in each respective output path by means of subtractors 135*a*, 135*b* and 135*c*. The loudspeakers preferably are arranged as shown in FIG. 2.

In another mode of operation, the receiver of FIG. 8 further includes an additional output channel composed of a subtractor 135*d*, a de-emphasis network 131*d*, an amplifier 132*d* and a loudspeaker 133*d*. This operational mode is activated by the closure of a switch 136 between gating system 130 and subtractor 135*d* and of a switch 137 between attenuator 134 and that same subtractor. As a result, the receiver also produces an output audio signal (A+B), representing the arithmetical operation:

$$(A+B+C+D) + (A+B) - (C+D) = 2(A+B) \qquad (4a)$$

Accordingly, the loudspeakers are now arranged as shown in FIG. 9, so that the quantities (A+C), (C+D), (B+D) and (A+B) appear respectively at the left, rear, right and front of listener 25. As indicated by dashed-line loudspeaker representations in FIG. 9, this simulates reproduction by four sources A, B, C and D arranged as in FIG. 1. Yet, information contained in only the first three terms of the modulation function of equation (2) has been utilized in this mode as in the one immediately above. That is, only one subcarrier frequency is employed as in the case of conventional two-channel stereo systems. As compared with the latter, however, a quadrature component has also been used. Synchronization again is with respect to the axes represented by vectors 67 and 68 in FIG. 5.

FIG. 10 represents a possible alternative to the arrangement of FIG. 9. In this case, loudspeakers 138*a*, *b*, *c* and *d* are arranged around listener 25 as in FIG. 1 for loudspeakers 21, 22, 23 and 24, respectively. The output signals fed to each of loudspeakers 138*a*, *b*, *c* and *d* are (C+2A+B), (A+2B+D), (B+2D+C) and (A+2C+D), respectively. Of course, these particular signals may be produced by simple algebraic matrixing of the signals produced by the receiver of FIG. 8 for the reproducer system discussed above with respect to FIG. 9. In each case, the loudspeaker in FIG. 10 reproduces a predominant audio component of the FIG. 1 type at the appropriate location together with coherent components additively balanced from the two locations on either side of that location.

Figure 11:
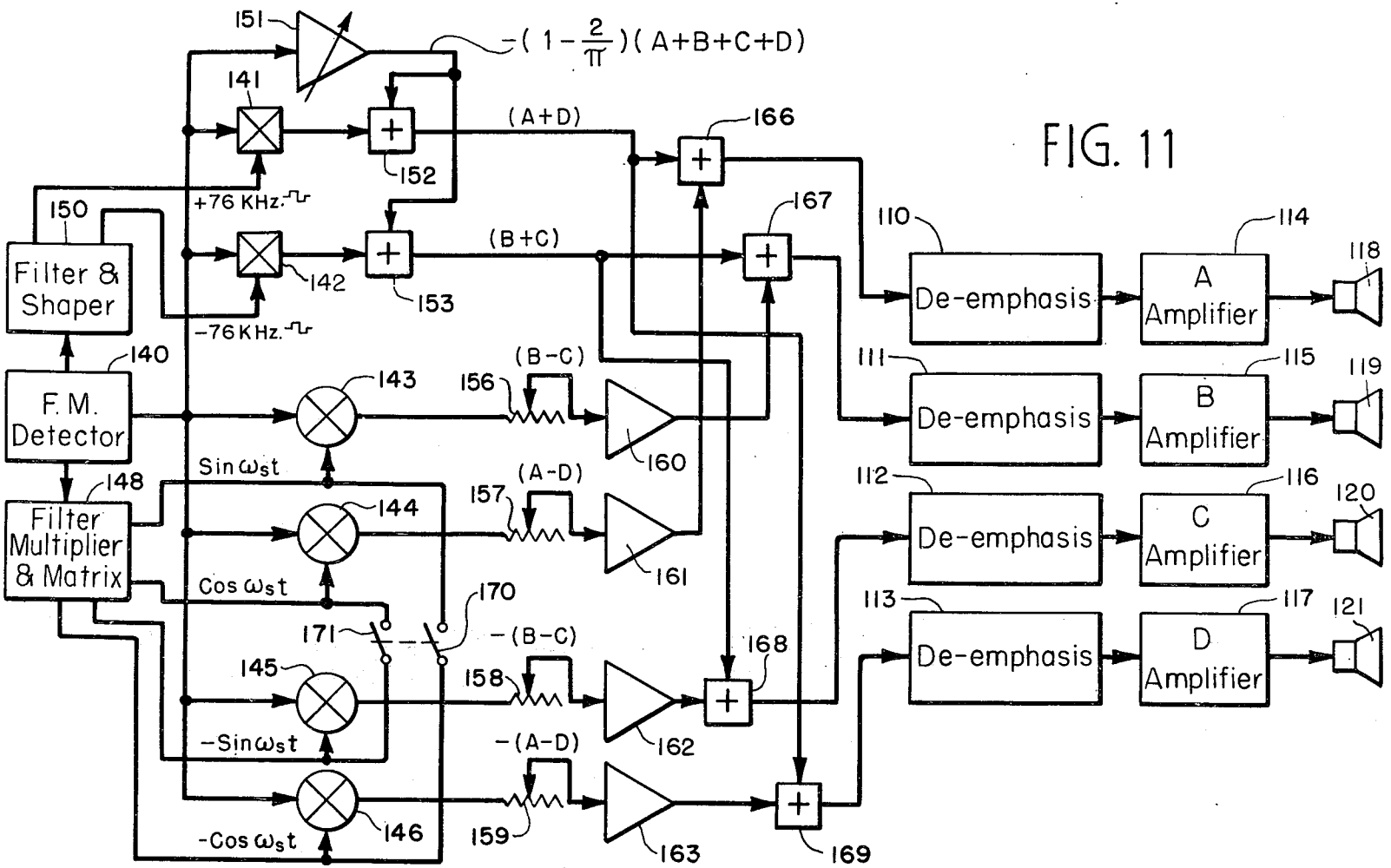
FIG. 11 is a partially schematic block diagram of a four-channel receiver alternative to that of FIG. 7.

FIG. 11 depicts a modification of the receiver of FIG. 7 for the purpose of developing a full four-channel stereo program. Thus, an FM detector 140 represents the discriminator portion of network 104 in FIG. 7. The detected composite modulation function of equation (2) is fed to each of first and second gates 141 and 142 and product detectors 143, 144, 145 and 146. A filter, multiplier and matrix network 148 serves to derive the 19 kHz pilot signal $K_5S''$ double that signal and, by means of phase shifting and inverting circuits, develop demodulation signals of the forms $(\sin\omega_s t)$, $(\cos\omega_s t)$, $(-\sin\omega_s t)$ and $(-\cos\omega_s t)$. These demodulation signals individually are fed respectively to product detectors 143, 144, 145 and 146. Each of the product detectors functions as a synchronous demodulator and together they function to demodulate the audio information within the composite modulation function of equation (2) so as respectively to derive the information represented in the phasor diagram of FIG. 5 respectively at 0°, 90°, 180° and 270°. The four product detectors 143, 144, 145 and 146 thus yield the separated audio components (B−C), (A−D), −(B−C) and −(A−D), respectively.

A filter and shaper network 150 extracts the 76 kHz fourth harmonic of the 19 kHz pilot signal and develops a pair of sampling signals of the form $1\pm(4/\pi)\cos\omega_{s2}t$ that are fed respectively to gates 141 and 142. Gates 141 and 142 serve as binary or on-off switches and thus operate upon the fourth term in the modulation function of equation (2). As also in the case of FIG. 7, the lack of complete separation inherent in the operation of gate 141 is equalized or compensated by combining therewith a modifying signal of the form $-(1-2/\pi)$ (A+B+C+D). To this end, the main-channel audio portion of the composite modulation function from detector 140 is fed through an amplifier 151 and summed in an adder 152 with the audio component derived from the output of gate 141. Amplifier 151 is adjustable in gain so that the precise level of compensating signal may be obtained; amplifier 151 thereby serves as a separation control. Similarly, the compensating signal from the output of amplifier 151 is also combined with the audio component from the output of gate 142 in an adder 153. Consequently, the modified signals sampled through gates 141 and 142 are of the form (A+D) and (B+C), respectively.

It may be helpful to explain the reasons for the nature of the particular demodulating processes indicated for gates 141 and 142. As may be deduced from the aforementioned Adler et al. patent, a signal component having a form such as that of the fourth term of equation (2) may be demodulated by operating upon it with a multiplier of the form $1\pm2\cos\omega_{s2}t$. In this manner, the audio information modulated upon the fourth term of equation (2) would be derived directly by operation of the gating system. In view of the inconvenience or impracticability of arriving at multipliers of the form just discussed, however, use is made of a sampling square wave for the second term of equation (2) of the abovementioned form:

$$1\pm(4/\pi)\cos\omega_{s2}t. \tag{6}$$

A half sine wave may also be used which corresponds to the multiplier $1\pm(\pi/2)\cos\omega_{s2}t$. As also explained in the aforementioned articles, use of a multiplying or sampling waveform of the kind represented by equation (6) necessitates the already mentioned modification or equalization of the derived modulation components in order ultimately to obtain clean separation between the different primary stereo audio signals. This process of equalization may be understood by a detailed examination of the sampling of one phase of the fourth term in equation (2). In this case, then, the multiplying wave is of the form $1+4/\pi(\cos\omega_{s2}t)$. The multiplication of that term with the modulation function of equation (2) as obtained from the discriminator in network 104 may be expressed:

$$\{(A+B+C+D) + [(A+D) - (B+C)]\cos\omega_{s2}t\}(1+4/\pi\cos\omega_{s2}t) \tag{7}$$

The multiplication process yields:

$$(A+B+C+D) + 4/\pi[(A+D)-(B+C)]\cos2\omega_{s2}t + \ldots \tag{8}$$

Since the needed information is contained entirely within the indicated first two terms of equation (8), the useful portion of that equation may be expressed:

$$(A+B+C+D)+4/\pi[(A+D)-(B+C)]\ (\tfrac{1}{2}+\tfrac{1}{2}\cos2\omega_{s2}t) = (A+B+C+D)+2/\pi[(A+D)-(B+C)] = 1.673(A+D) + 0.363(B+C) \tag{9}$$

Whereas the desired result of the multiplication process represented by equation (7) would be the development of a pure audio component of the form (A+D), it is observed that, instead, the resultant includes a contribution of (B+C), representing a separation of only 13db.

While corrective weighting might be accomplished in different ways, a direct approach is to include amplifier 151 which supplies the correcting modifier. That modifier is the now familiar quantity $[-(1-2/\pi\lambda)(A+B+C+D)]$. Thus, equation (9 ) is modified as follows:

$$(A+B+C+D) + (2/\pi)[(A+D)-(B+C)] + [-(1-2/\pi\lambda)(A+B+C+D)] = 4/\pi\ (A+D) \tag{10}$$

Accordingly the process begun in equation (7) as now modified yields a completely separated form of the audio information (A+D). By in the same manner modifying the other resultant obtained by combining the other polarity of the fourth term of equation (2) with the respective modifier, a cleanly separated signal also is obtained of the form (B+C).

With development of the signals as thus far discussed in connection with the receiver of FIG. 11, it will be observed that it now is necessary only to additively matrix a total of six audio components in order to derive the ultimately desired four primary stereo signals. The audio components from each of product detectors 143–146 are individually fed through respective adjustable attenuators 156, 157, 158 and 159 and amplifiers 160, 161, 162 and 163. Amplifiers 160–163 serve to bring up the level of the audio components they individually handle to a value equal to that of the audio components developed by gates 141 and 142 and then modified. Adjustable attenuators 156–159 serve as additional separation controls for the purpose of enabling the clean development of each different signal component.

Finally, an adder 166 sums the (A+D) and (A−D) to yield the A stereo signal. An adder 167 sums the ((B+C) and (B−C) signal components to yield the B stereo signal. Similarly, the C stereo signal is obtained by summation in an adder 168 of the (B+C) and −(B−C) audio components, while an adder 169 sums the (A+D) and −(A−D) audio components to develop the D stereo signal. As in FIG. 7, the four separate stereo signals are then fed through their respective chains of de-emphasis networks and amplifiers to the individually corresponding loudspeakers 118–121.

Preferably, the receiver of FIG. 11 also is arranged to permit reproduction from a broadcast two-channel stereo signal as well as from a broadcast monaural signal. For monaural reception, all this requires in principle is the provision of a channel for transmitting the main-carrier audio component (A+B+C+D) in common to all four of the output audio signal channels. This may be accomplished directly by having a channel connected between detector 140 and each of de-emphasis networks 110–113, while including in that additional channel a gate responsive to the absence of the 19 kHz pilot signal for passing the main-channel audio component. Accordingly, gates 141 and 142 are arranged to remain open in response to the absence of the 19 kHz pilot signal, preferably with the concurrent disablement of amplifier 151, so as to pass the main-channel audio component (A+B+C+D) through each of adders 166–169 to all of the audio output channels. At the same time, each of product detectors 143–146 are arranged to operate in a manner such that they are disabled in the absence of their reference signals. That is, they include a threshold so as to be operative except in the absence of an applied reference signal.

For the reception of a two-channel stereo broadcast signal, the receiver of FIG. 11 is arranged so that a demodulated and matrixed left signal L is fed in common to the A and C output audio channels while a similarly derived right signal R is fed in common to the B and D output audio channels. To that end, ganged switches 170 and 171 are closed, preferably automatically in response to the absence of the 76 kHz pilot signal but in the presence of the 19 kHz pilot signal, to connect in parallel the reference signal inputs of product detectors 143 and 146 and 144 and 145, respectively. This forces the thusly paired product detectors to operate on the respective axes represented by vectors 67 and 68 of FIG. 5. As in the case of monophonic reception, gates 141 and 142 are held open to pass the main-channel signal (L+R). In operation, detectors 143 and 146 produce a negative difference signal −(L−R), while detectors 144 and 145 produce a positive difference signal (L−R). Adders 166 and 168 both sum an (L+R) component derived from one of gates 141 and 142 with an (L−R) component derived by detectors 144 and 145 respectively. In consequence, an audio component of the form (A+C) or (L) is fed to both of output channels A and C. At the same time, adders 167 and 169 each sum an (L+R) signal derived from one of gates 141 and 142 with a −(L−R) signal obtained by way of product detectors 143 and 146, respectively. As a result, an audio signal of the form (B+D) or (R) is fed to each of output audio channels B and D. Further analysis of the correlated relationship between the different audio components will reveal a variety of other combinations of the circuitry that may be utilized for the purpose of performing the necessary arithmetical operations to energize the different ones of the loudspeakers with the appropriate ones of the left and right signals present in the two-channel stereo broadcasts.

Figure 12:
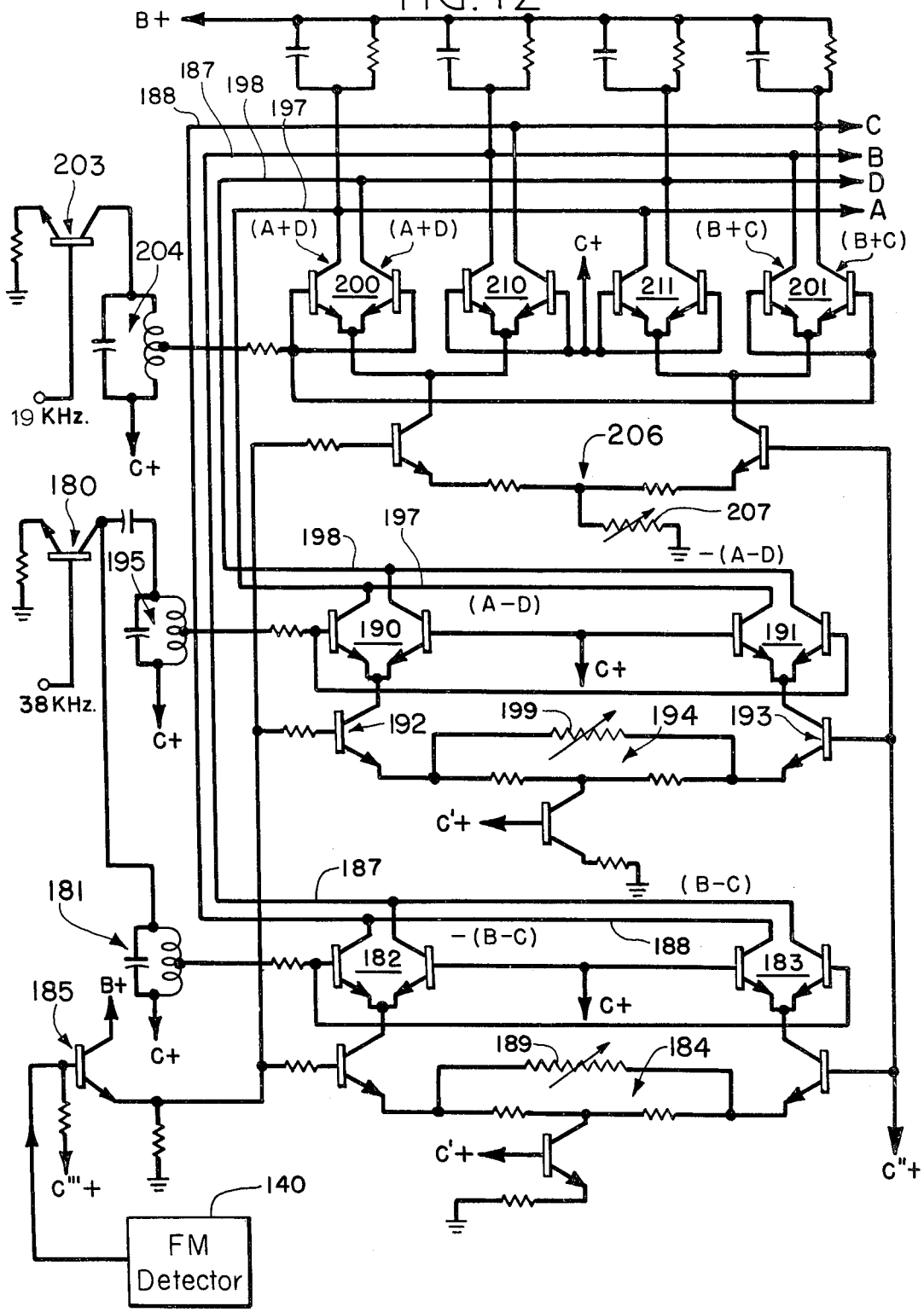
FIG. 12 is a detailed schematic diagram of a portion of the receiver of FIG. 11.

FIG. 12 sets forth a more detailed schematic diagram of an audio derivation approach that may be used in conjunction with the receiver of FIG. 11. By way of an isolation transistor stage 180 and a phase-selective tuned circuit 181, the 38 kHz second harmonic of the 19 kHz pilot signal, in the form $\sin\omega_s t$, is injected at the base of one transistor of the two in each of a pair of product detectors 182 and 183. A bridged-T network 184 includes a constant current source in the form of a fixed-bias transistor in its common leg for maximum common-mode rejection, and a pair of driver transistors individually in each of its respective arms with the latter individually driving the common emitters of each of product-detector pairs 182 and 183. From detector 140 through an isolation transistor stage 185, the composite modulation function of equation (2) is applied to the base of the driver transistor directly coupled to product-detector 182. The base of the other driver transistor is fixed biased as are the bases of the transistors in the product detectors not coupled directly to the 38 kHz reference signal. In operation, the audio component (B−C) appears on the collectors of one transistor of each product-detector pair connected to a lead 187, while the audio component −(B−C) appears on the remaining collectors of the two detectors that are connected to another lead 188. The bridging resistor 189 in the T-network serves as a gain control to permit adjustment of balance between the product-detector and the additional detectors described below.

A physically similar pair of product detectors 190 and 191 are individually driven by respective driving transistors 192 and 193 which are included in the respective arms of another bridged-T network 194, which also includes a fixed-bias transistor in its common leg for common-mode rejection. The remaining bias arrangements also are the same as network 184, and the composite modulation function from isolation stage 185 is inserted on the base of driving transistor 192. A 38 kHz reference signal of the form $\cos\omega_s t$ is delivered from a phase-determining tuned circuit 195 to the bases of one transistor in each of the product-detectors 190 and 191. In this case, the phase of the applied reference signal effects operation of the product detector pairs to derive the audio quantity (A−D) on the one collector in each product detector connected to a lead 197. The other collectors are connected to a lead 198 and derive the audio component −(A−D). Again, an adjustable resistor 199 in bridged-T network 194 serves as a gain control.

In the upper level of components in FIG. 12 are gate pairs 200 and 201 with the emitters and bases in each pair being connected in common. A 76 kHz switching signal, again derived directly or indirectly from the 19 kHz pilot signal, is fed through an isolating stage 203 and a phase-selective tuned circuit 204 to the bases of each of the gate pairs 200 and 201. The reference signal amplitude is sufficient to saturate, and thus cut off, gate pairs 200 and 201 so as to create a switching function having a multiplier of the form $1 \pm 4/\pi \cos\omega_{s2} t$. Connected between the common emitters of each gate pair 200 and 201 are the arms of a resistive T network 206 with each arm including a driver transistor and the common leg having an adjustable resistor 207 serving as a separation control. The composite modulation function from isolating stage 185 is fed to the base of the transistor in network 206 directly connected to the emitters of gate pair 200, while the base of the transistor in the other arm is returned to a point of fixed bias.

In response to the 76 kHz pulsed switching signal and the composite modulation function, an audio component (A+D) appears on the collector of each transistor in gate pair 200, while the audio quantity (B+C) appears on the collectors of each transistor in gate pair 201. The individual collectors of gate pair 200 are connected respectively to leads 197 and 198, and the individual collectors of gate pair 201 are individually connected to respective leads 187 and 188. Adding these different audio components to the several audio components individually applied to the respective different leads by the product detectors as previously described, it will be seen that the resultant audio signals on leads 188, 187, 198 and 197 are predominantly of the respective forms C, B, D and A.

However, as discussed above in connection with the rectangular wave sampling process of gates 141 and 142 in the receiver of FIG. 11, the multiplying process in gate pairs 200 and 201 results in a need for equalization or compensation by the additional summation of a modifier of the form $-(1-2/\pi)$ (A+B+C+D). This is accomplished by means of amplifier pairs 210 and 211 each composed of two transistors and with the bases of all four transistors being returned in common to a point of fixed bias. The collectors of the four transistors are individually connected to the respective different ones of leads 187, 188, 197 and 198. The emitters of amplifier pair 210 are connected to the collector of the transistor in one arm of T-network 206, while the emittters of the other amplifier pair 211 are connected to the collector of the transistor in the other arm of that network. In consequence, a weighted portion of the main channel component (A+B+C+D) of the modulating function is supplied by amplifier pairs 210 and 211 to each of leads 187, 188, 197 and 198 so that pure primary audio stereo signals B, C, A and D are developed on the respective leads for delivery to the respective output audio channels as shown in FIG. 11.

As specifically arranged in FIG. 12, direct-current energization of the overall circuitry is obtained by connecting a source of B+ through separate decoupling networks to all of the collectors of the different transistor pairs, 200, 201, 210 and 211, while the common leg of each T-network is returned to ground. The various different bases are returned to appropriate sources of bias potential as is one terminal of the transistor in each isolating stage, and the emitter of the transistor in each isolating stage also returned to ground or a plane of reference potential.

Figure 13:
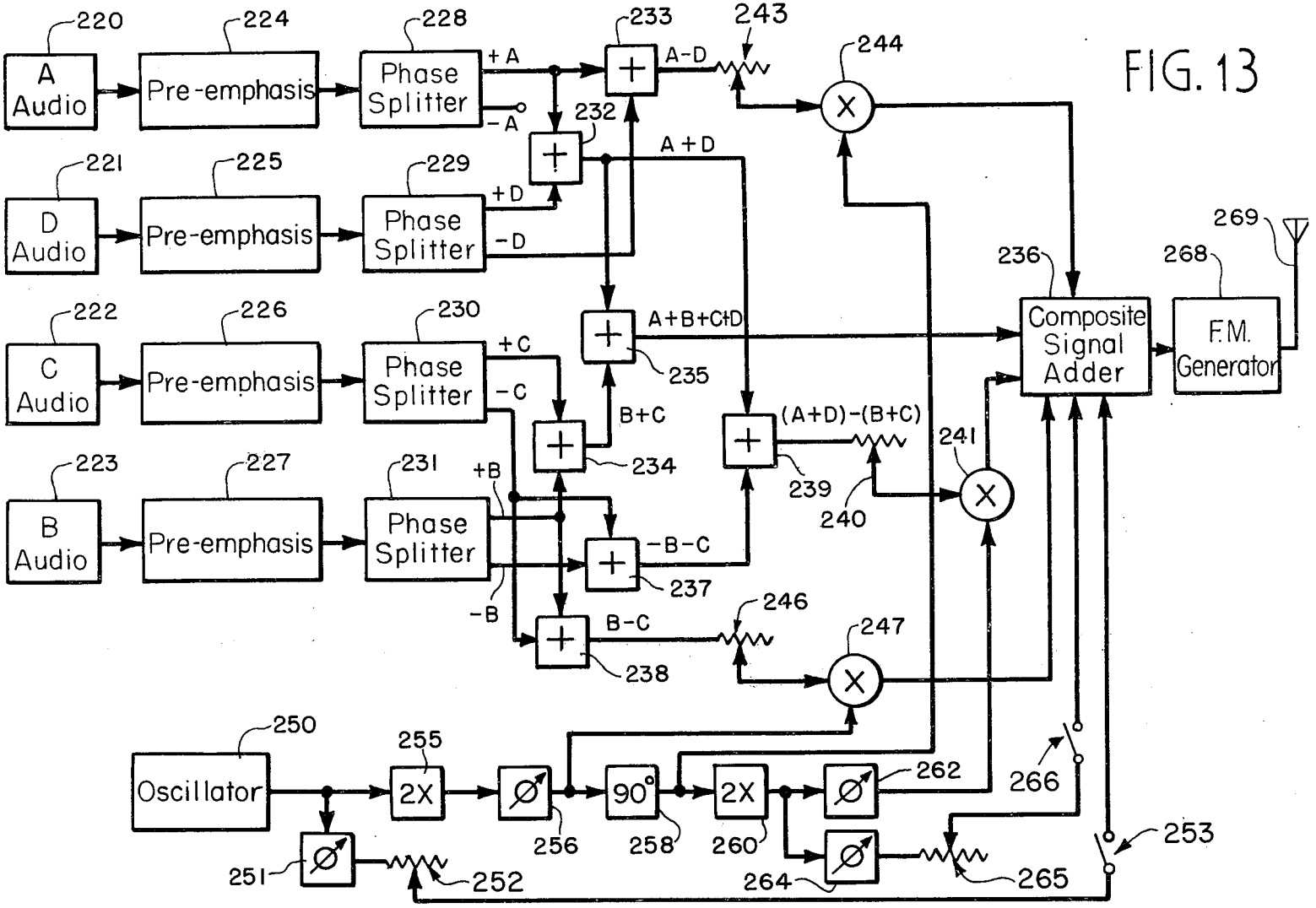
FIG. 13 is a partially schematic block diagram of a four-channel stereo transmitter alternative to that of FIG. 3.

FIG. 13 represents a broadcast transmitter alternative to that of FIG. 3. In contrast with the time multiplex approach in the design of FIG. 3, however, the basis of the arrangement in FIG. 13 is that of the synthesis of the modulation function of equation (2) by operation separately with respect to the four different basic terms in that equation. Thus, the four different primary audio stereo signals A, D, C and B, picked up live or derived from a four-track recording, are delivered by respective sources 220, 221, 222 and 223 through corresponding pre-emphasis networks 224, 225, 226 and 227 to particular phase splitters 228, 229, 230 and 231. Each phase splitter develops a positive and negative version of the respective signal fed to it, although in this particular arrangement the negative quantity of the audio signal A is not used.

An adder 232 sums the +A and +D signals to yield the audio components (A+D), while another adder 233 combines the +A and −D signals to yield the component (A−D). Similarly, an adder 234 sums the +C signal and the +B signal to produce (B+C) which, in turn, is fed to still another adder 235 for combination with the (A+D) signal to yield the main-channel audio component (A+B+C+D). The latter is fed directly to a composite signal adder 236. Additionally, an adder 237 combines the −C and −B audio signals to yield an audio quantity (−B−C), and a still further adder 238 sums the +B and −C audio signals to deliver the audio component (B−C). The (A+D) and (−B−C) components respectively from adders 232 and 237 are combined in a final adder 239 to yield the audio component (A+D)−(B+C), and the latter is fed through an adjustable attenuator 240 to a multiplier 241. Similarly, the (A−D) component from adder 233 is fed through an adjustable attenuator 243 to a multiplier 244, and the (B−C) component from 238 is fed through an adjustable attenuator 246 to a multiplier 247.

For developing the different pilot and multiplying signals, the transmitter of FIG. 13 utilizes a chain of stages basically like that in FIG. 3. That is, an oscillator 250 serves as a stable source of a 19 kHz fundamental component that is fed through a phase adjuster 251, an amplitude control 252 and a switch 253 to composite signal adder 236 in order to insert the pilot signal $K_5S''$. As before, switch 253 is opened when only the monaural component (A+B+C+D) is transmitted so as to permit appropriate response by stereo receivers.

The fundamental reference signal from oscillator 250 also is doubled in a frequency multiplier 255 and then fed through a phase adjuster 256 to develop a subcarrier of the form $\sin\omega_s t$ which is fed to multiplier 247. By operation of the latter, the third term of equation (2), $K_3(B-C)\sin\omega_s t$, is developed and fed to composite signal adder 236. The reference signal at the output of phase adjuster 256 also is changed in phase by 90° in a phase shifter 258 to develop a subcarrier signal of the form $\cos\omega_s t$, and this latter subcarrier signal is then fed to multiplier 244, the action of which is to produce and feed to composite signal adder 236 the second term of equation (2) of the form $K_2(A-D)\cos\omega_s t$.

The reference signal at the output of shifter 258 also is again doubled in another frequency multiplier 260 and then in part fed through a phase shifter 262 for development of the subcarrier signal $\cos\omega_{s2}t$. The latter is then supplied to multiplier 241 which functions to produce and feed to composite signal adder 236 the last term of equation (2) in the form $K_4[(A+D)-(B+C)]\cos\omega_{s2}t$. An additional portion of the reference signal from frequency multiplier 260 is fed through a phase shifter 264, an amplitude control 265 and a switch 266 to composite signal adder 236. Switch 266 is open except during the transmission of four-channel stereo information, so that the higher-frequency pilot signal $K_6S'''$ is present only during the broadcast of that stereo mode. Finally, the now-complete composite modulation function of equation (2) together with the two pilot signals is fed from adder 236 to frequency modulate the main-carrier developed by a generator 268 and fed to an antenna 269.

Figure 14:
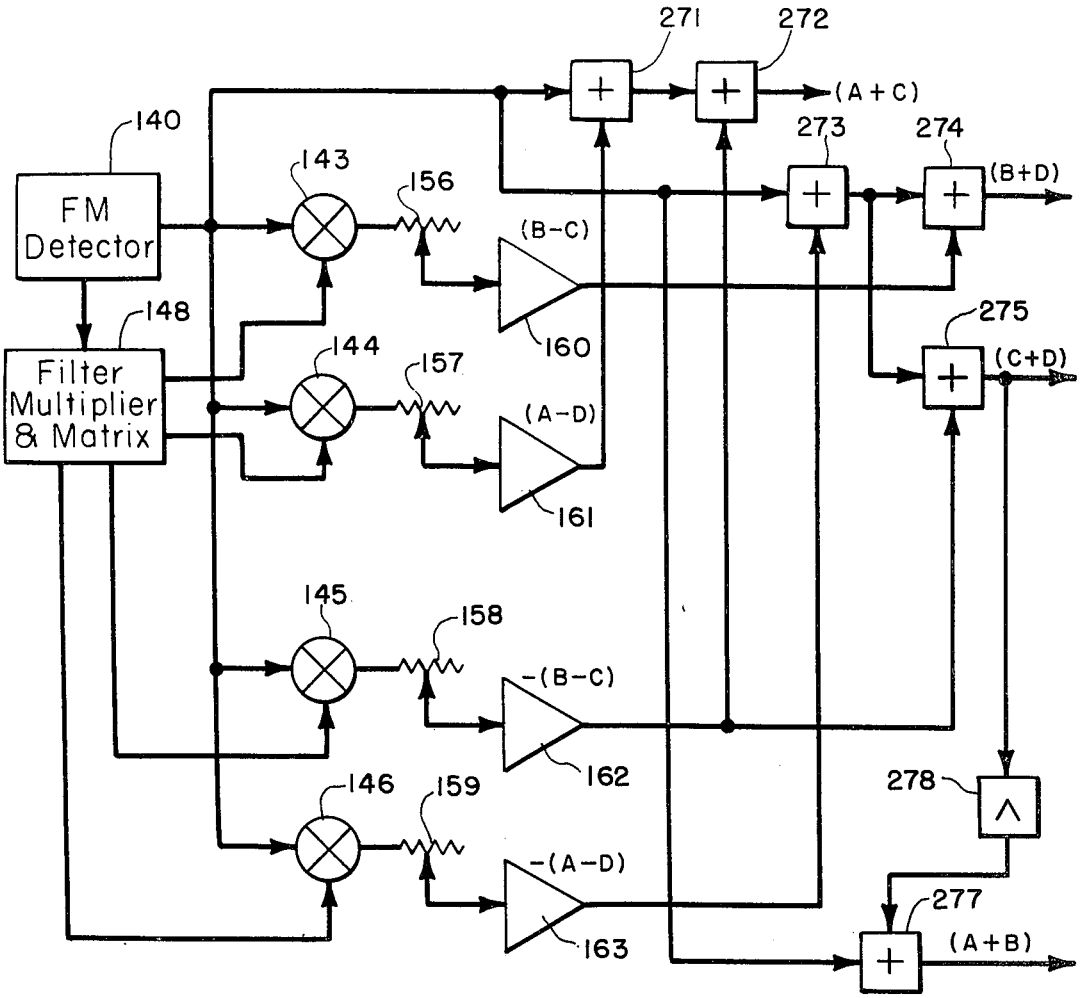
FIG. 14 is a partially schematic block diagram of a receiver similar to that of FIG. 11 but particularly arranged to reproduce a three-channel or four-channel stereo signal from a three-channel stereo broadcast.

In FIG. 14 the receiver of FIG. 11 has been modified so as to enable the development of either three or four output audio stereo signals that simulate four-channel reproduction in the manner discussed in connection with FIGS. 2 and 9. To this end, the apparatus and manner of operation of the receiver of FIG. 14 is the same as that in FIG. 11 in each different signal path through amplifiers 160–163. Departing from the arrangement of FIG. 11, the main-channel audio component (A+B+C+D) is derived directly from detector 140. The latter quantity is then summed in an adder 271 with a component (A−D) from amplifier 161 and then again in an adder 272 with the component −(B−C) from amplifier 162 to yield a stereo component of the form (A+C). In an adder 273, another portion of the main-channel component is summed with the component −(A−D) from amplifier 163 and that combination then is further summed in an adder 274 with the component (B−C) from amplifier 160 to yield a second audio stereo signal of the form (B+D). Next, the combination at the output of adder 273 also is summed in another adder 275 with the component −(B−C) so as to yield the third stereo audio signal of the form (C+D). These three audio stereo signals of the forms (A+C), (B+D) and (C+D) may then be fed to the respective output channels of FIG. 8 so as to permit reproduction of the corresponding different ones of these stereo signals by loudspeakers 133*a*, 133*b* and 133*c* which are arranged in the manner of FIG. 2.

As shown, the receiver of FIG. 14 also includes another adder 277 which receives both the main channel component and a component −(C+D) derived from the output of adder 275 by way of an inverter 278. Consequently, adder 277 develops a further audio stereo signal of the form (A+B) which then may be fed to the corresponding audio channel in FIG. 8 that terminates with loudspeaker 133*d*, all of the loudspeakers in this case being arranged in the manner of FIG. 9. As in the case of the receiver of FIG. 8, different matrixing schemes may be incorporated in the receiver of FIG. 14 so as to instead utilize the reproduction pattern of FIG. 10.

Several different transmitters and receivers have been described to illustrate the attributes of a four-channel FM stereo transmission system which also permits a mode of three-channel reproduction that produces an equivalent effect. Because of that equivalence, attention has also been directed to transmitters and receivers based initially on a three-channel mode of broadcasting and reception. At the same time, both three-channel and four-channel systems have been disclosed which permit full and complete compatibility with receivers designed for different stereo modes as well as those that reproduce only monophonic information.

While particular matrixing or signal combining arrangements have been described for performing different arithmetical operations according to various specific techniques, an analysis of the different combinations of the fundamental stereo signals that might be made together with the specific audio information to be contained in the broadcast modulation function reveals that other and different arithmetical approaches may be utilized. In a transmitter, for example, the desired three-channel modulation components (A+C), (B+D) and (C+D) may be obtained simply by adding to the monaural component (A+B+C+D) the respective quantities −(C+D), −(A+C) and −(A+B). As another example, an alternate four-channel stereo receiver approach also begins with the development of the monaural component (A+B+C+D). The stereo signal A is then obtained by adding to that monaural component the quantities (A−D) and −(B+C). Similarly, the stereo signal B is obtained by instead adding the components (B−C) and −(A+D), while the stereo signal C is produced by adding −(B−C) and −(A+D). Finally, the stereo signal D is developed by summing the monaural signal with both the components −(A−D) and −(B+C).

In any event, the overall system concepts, as well as the specific receiver and transmitter approaches, of the present invention not only provide four-channel and three-channel stereo systems that are compatible with conventional two-channel stereophonic and one-channel monaural broadcasting, but the arrangements are consistent with the use of present-day four-channel stereo tape recordings as well as with the bandwidth and other requirements of existing commercial broadcast standards. Noting also that an existing two-channel stereo receiver will produce a portion of the information contained in a three-channel or four-channel transmission, it is apparent that an adapting unit may be coupled into such a two-channel receiver in order to expand its function to include the reproduction of additional channels. The addition of still further adapting components similarly would enable the modification of a monophonic receiver for the purpose of reproducing stereophonic broadcasts of any of the different stereo modes. Analogously, present-day monophonic or two-channel stereo broadcast transmitters, by application of the principles of the present invention, may be modified so as additionally to be capable of broadcasting the further stereo modes herein presented.

There are described above a number of four-channel stereo transmitter and receiver embodiments which do not specifically provide for an SCA (Subsidiary Communications Authorization) channel. It is an object of this invention to provide systems and methods for communicating four full-bandwidth independent channels which provide spectrum space for an SCA channel.

FIG. 15 illustrates a four-channel stereo signal transmitting system which is similar to the above-described FIG. 3 transmitter, but which provides for the inclusion of an SCA channel. Recall that the FIG. 3 transmitter is described above as generating a modulation function as defined by equation (2) above in which the second sub-carrier $\omega_{s2}$, representing a second harmonic of the first sub-carrier $\omega_s$ and a fourth harmonic of the pilot signal, is suppressed-carrier, double sideband amplitude-modulated by the function $K_4[(A+D)-(C+B)]$. In the described FIG. 3 transmitter, the described second harmonic sub-carrier is assigned a frequency $(\frac{1}{2}\pi)\omega_{s2}$ of 76kHz. FCC regulations allow provision in two-channel FM stereo communication systems for an SCA channel between 53 and 75kHz.

In accordance with one aspect of this invention a four-channel stereo transmitter is provided in which the lower sideband of the second harmonic sub-carrier $\omega_{s2}$ is suppressed or removed to provide for selective transmission and reception of an SCA channel which is located in frequency in the position of the missing lower sideband of the second harmonic sub-carrier. A number of systems and methods are contemplated for achieving the described single sideband modulation of the 76kHz sub-carrier without significantly degrading the performance of the basic four-channel stereo communication systems, as described above.

A preferred method for achieving the desired single sideband modulation, herein termed the phasing method, is described generally in U.S. Pat. No. 1,666,206, and in the following publications:

1. *Design of RC Wide-Band 90° Phase-Difference Network;* by Donald K. Weaver, Jr., Proceedings of the IRE, p. 671–676, April, 1954;

2. *Normalized Design of* 90° *Phase-Difference Networks;* by S. Bedrosian, IRE Transactions on Circuit Theory, June, 1960, pp. 128–136; and
3. *Broad-Band Passive* 90° *RC Hybrid . . . ;* by A. Rogers, IEEE Proceedings Letters, November, 1971, pages 1617–1618.

As background for a discussion of the FIG. 15 transmission system, and other subsequently described embodiments of this invention, this phasing method of single sideband modulation will be described briefly and in general terms, with reference to FIGS. 16 and 17. FIG. 16 shows a system in which a simple sinusoidal input signal $A\cos\omega t$ is supplied to parallel circuit branches, one of which contains a first phasing network 300, to be described below, and a balanced modulator 302. The second circuit branch includes a second phasing network 304 and a second balanced modulator 306. The two circuit branches are rejoined in an adder 308.

The first and second phasing networks 300, 304 apply to the signals in the respective branches predetermined phase-versus-frequency characteristics. The said characteristics are such that a 90° phase difference is established between the signals in the two circuit branches, assuming phasing means 300 has least phase shift. In the present specification, phasing means introducing the relatively lesser phase shift are termed P-type; the companion phasing means is termed N-type. In a practical system, the phasing networks 300, 304 are designed to produce a 90° phase difference between the signals in the two branches over a selected band of frequencies. In the present application the frequency band of interest is the band of audio frequencies between about 50–15,000Hz.

FIG. 17 illustrates hypothetical phase-versus-frequency characteristics 310, 312 which might be produced by the P-type and N-type phasing networks 300, 304, respectively. In FIG. 17 the frequency band of interest is $\omega_2-\omega_1$. The balanced modulators 302, 306 are supplied with reference signals $\cos\omega_c t$ and $\sin\omega_c t$, respectively. As shown by the annotations on FIG. 16, upon adding the outputs of the modulators 302, 306 a selected one of the sidebands of the carrier $\omega_c$, depicted as being the lower sideband, is cancelled, leaving only the upper sideband.

This upper sideband signal can be represented as $A\cos\omega_c t - \hat{A}\sin\omega_c t$ where $\hat{A}$ is an audio signal, not necessarily sinusoidal, and A represents the Hilbert transform of A, which means that every frequency component of $\hat{A}$ is shifted 90° in phase relative to every respective component in A. For example, for $A = \cos\omega t$, $\hat{A} = \sin\omega t$.

Referring to the phasing networks 300, 304, where network 304 (N-type) produces 90° more phase shift than network 300, it can be said that networks 300, 304 have outputs A and $-\hat{A}$, respectively.

As noted above, the FIG. 15 transmitter represents the above-described FIG. 3 transmitter modified to provide for an SCA channel. Reference numerals in FIG. 15 which are like those in FIG. 3 identify system components having similar function. In order to modify the FIG. 3 transmitter for single sideband modulation of the second harmonic (76kHz) sub-carrier, there are inserted in the four input audio channels following the pre-emphasis networks, 45, 46, 47 and 48 like phasing networks 314, 316, 318 and 320; the phasing networks may be constructed as described in the above-noted prior art references. Phasing networks 314, 316, 318, 320 introduce a like predetermined phase-versus-frequency characteristic, herein shown as being of the P-type, over a predetermined band of audio frequencies in each of the four audio input signals.

As described in detail above in connection with the FIG. 3 transmitter, the gates 50, 51, 52 and 53 time-multiplex the four audio input signals to develop a modulation function which includes a 76kHz sub-carrier modulated by a function proportional to [(A+D)−(C+B)]. In the FIG. 15 system the complete modulation function, including the described 76kHz sub-carrier component, is subjected to the said phase-versus-frequency characteristic of the like phasing networks 314, 316, 318 and 320.

To achieve cancellation of the lower sideband of the 76kHz sub-carrier so as to provide spectrum space for an SCA channel centered at about 67kHz, there is provided a matrix 322 receiving as inputs the four pre-emphasized audio input signals. The matrix 322 is so constructed as to produce an auxiliary four-element difference signal (A+D)−(B+C).

The described auxiliary difference signal produced by the matrix 322 is fed to a phasing network 324 which impresses on the difference signal a second predetermined phase-versus-frequency characteristic, here shown as being of the N-type. The phase-shifted auxiliary difference signal developed by the phasing network 324 is fed to a balanced modulator 326 receiving a 76kHz reference signal, $-\sin\omega_{s2}t$, from multiplier 74 which has been phase shifted by 90° in a phase shifter 328 and adjusted in phase by means of a phase adjustor 330. The output signal from the balanced modulator 326 can be varied in amplitude by means of amplitude controller 327.

The phase shifted output signal may be described: $-[(\hat{A}+\hat{D})-(\hat{B}+\hat{C})]\sin 2\omega_2 t$. The four-element difference signal component developed by the gates 50, 51, 52 and 53 may be described: $[A+D)-(B+C)]\cos 2\omega_s t$.

The adder 54′ performs generally the functions of the adder 54 in the FIG. 3 system, but is modified to receive the described auxiliary four-element difference signal. The four-element difference signals are combined in the adder 54′ to effect cancellation of the lower sideband of the second sub-carrier, producing a resultant second harmonic sub-carrier modulation component:

$$[(A+D)-(B+C)]\cos 2\omega_s t - [(\hat{A}+\hat{D})-(\hat{B}+\hat{C})]\sin 2\omega_s t$$

An SCA signal generator 332 is illustrated as being coupled to the adder 54′ through a switch 334 representing means for introducing at the option of the broadcaster an SCA signal to accompany the basic four-channel stereo modulation function.

The FIG. 15 system can be considered as a time-division multiplexing system in which the four audio input signals are sampled in sequence according to a prescribed four-phase switching function. The invention is applicable also to signal encoding systems of the frequency-multiplex type wherein the signal components to be combined in a composite modulation function are generated in a frequency domain and subsequently combined.

Figure 18:
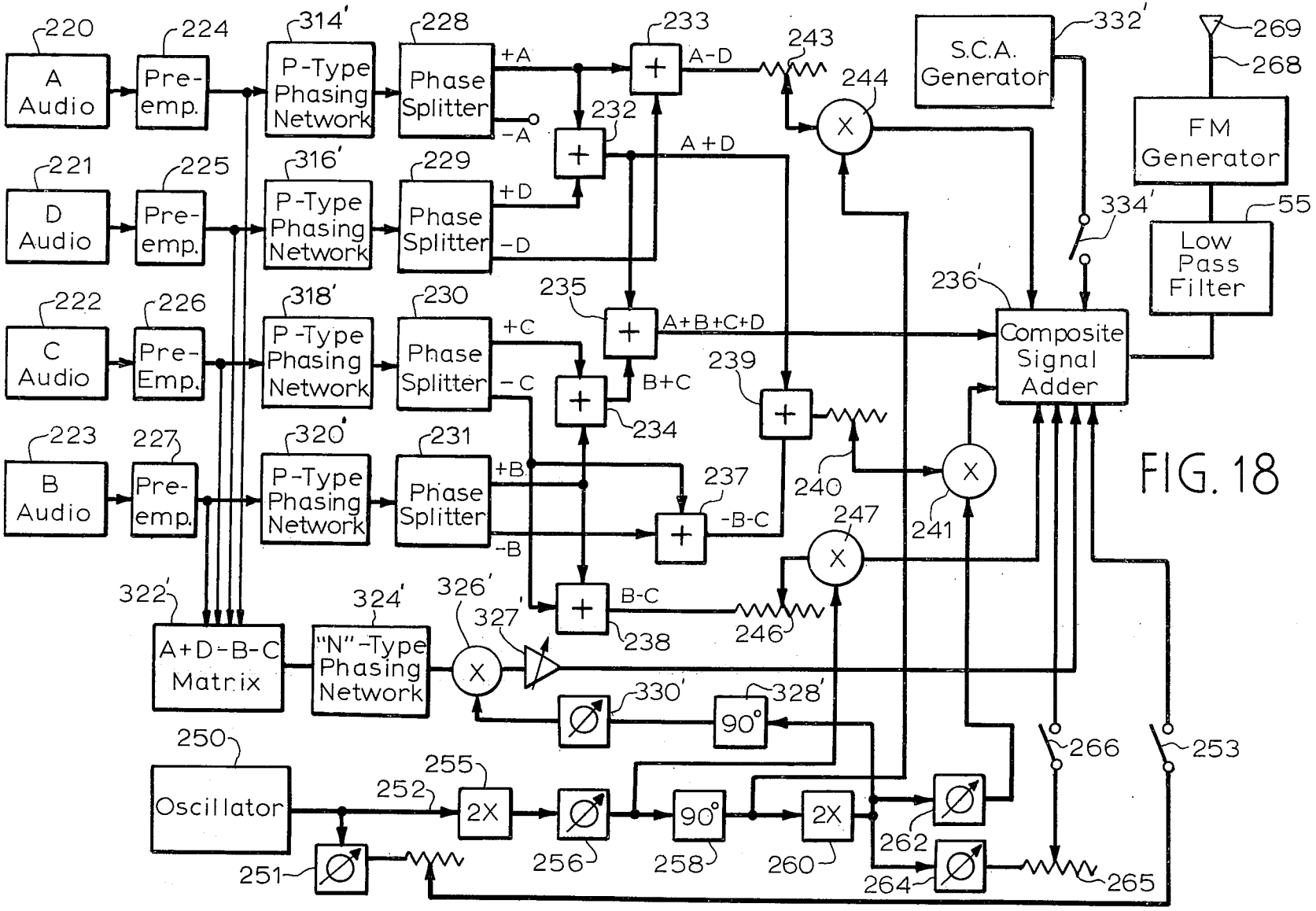
FIG. 18 illustrates a four-channel stereo transmitter similar to the FIG. 13 transmitter but having the capability of transmitting a signal which includes an SCA signal.

The above-described FIG. 13 transmitter may be characterized as a frequency-multiplex system. FIG. 18 illustrates the FIG. 13 transmitter modified according to this invention to incorporate an SCA channel. The FIG. 18 transmitter when compared to the FIG. 13 transmitter features modifications and additions similar to those made to the FIG. 3 transmitter to obtain the above-described FIG. 15 system. Primed reference numerals in FIG. 18 corresponding to those used in FIG. 15 identify like modifications and additions. The structure and operation of the FIG. 18 embodiment are deemed to be self-evident from an inspection of FIG. 18 taken in connection with the above description of the FIG. 13 system and the modified FIG. 15 version of the FIG. 3 system.

Whereas the FIG. 15 transmitter may be characterized as a purely time-division multiplex system, and whereas the FIG. 18 transmitter may be characterized as a purely frequency-division multiplex system, this invention contemplates other embodiments which might be characterized as hybrids, having both time-division and frequency-division multiplex components. Elaborating, the main channel and two 38kHz sub-carrier modulation components in quadrature may be generated in such a hybrid embodiment by the use of a 38kHz two-phase gating function; the 76kHz sub-carrier component may be generated in the frequency domain by the use of a single sideband modulation system.

It is also contemplated that other purely time-division multiplexing systems may be employed — for example, systems in which two two-phase gating functions, one operating at a 38kHz rate and the other at a 76kHz rate, generate separate modulation components which are subsequently combined.

An important aspect of this invention is to provide method and apparatus for controlling the phase of second harmonic (76kHz) sub-carriers or sub-carriers relative to the 38kHz sub-carriers in such a manner that the maximum possible peak voltage of the composite four-channel stereo signal is minimized when both 38kHz and 76kHz components are present simultaneously.

In the FIG. 3 encoder the four-channel stereo signal is generated by time-division multiplexing. As a result the four input audio signals are caused to be time-interleaved. This means that the maximum amplitude of the four-channel multiplexed signal is not larger than the maximum amplitude of the arithmatical sum of the four constituting signals. Even for a band-limited composite stereo signal this is still very nearly true.

The expression for the double sideband, amplitude-modulated second harmonic sub-carrier (76kHz), as developed by the FIG. 3 system, is $[(A+D)-(B+C)]\cos 2\omega_s t$.

When only the upper sideband of the 76kHz sub-carrier is present, as is the case in the FIGS. 15 and 18 systems, this desirable interleaving property is only partially achieved. The maximum instantaneous amplitude of the four-channel signal in these latter systems can exceed the individual signal maxima. The excess was experimentally found to be approximately 3db.

In accordance with one aspect of this invention it has been discovered that by establishing a predetermined phase relationship between the 38kHz sub-carriers in quadrature and the 76kHz sub-carriers, the maximum possible (worst possible situation) peak voltage of the composite four-channel stereo signal having 38kHz and 76kHz components present simultaneously can be minimized.

The four-channel stereo baseband signal except for pilot and SCA components can be represented by:

$$f(t) = (A+B+C+D) + \sqrt{2}(A-D)\cos\omega_s t + \sqrt{2}(B-C)\sin\omega_s t + [(A+D)-(B+C)]\cos 2\omega_s t - [(\hat{A}+\hat{D})-(\hat{B}+\hat{C})]\sin 2\omega_s t \quad (11)$$

In this expression the upper sideband of the second harmonic sub-carrier is represented by:

$$+[(A+D)-(B+C)]\cos 2\omega_s t - [(\hat{A}+\hat{D})-(\hat{B}+\hat{C})]\sin 2\omega_s t \quad (12)$$

In expression (12) the in-phase diagonal difference signal $[(A+D)-(B+C)]C)]$ the cosine wave and the Hilbert transform thereof modulates the sine wave.

It was found experimentally that if the maximum amplitude of the second harmonic sub-carrier, as expressed in (12), is reduced by approximately 30%, the interleaving is substantially as good as for a composite four-channel stereo signal that includes a double sideband second harmonic subcarrier, as developed for example by the system of FIG. 3.

The second harmonic sub-carrier upper sideband component is preferably reduced in amplitude to 0.7. Expression (12) may then be rewritten as:

$$0.7\{[(A+D)-(B+C)\cos 2\omega_s t - [(A+D)-(B+C)]\sin 2\omega_s t\} \quad (14)$$

The full expression (11) then becomes:

$$f(t) = A+B+C+D+ \sqrt{2}(A-D)\cos\omega_s t + \sqrt{2}(B-C)\sin\omega_s t + 0.7\{[(A+D)-(B+C)]\cos 2\omega_s t - [(A+D)-(B+C)]\sin 2\omega_s t\} \quad (15)$$

There has been described above a number of encoding systems and methods for developing a composite four-channel stereo signal in which the second harmonic sub-carrier is single sideband modulated to remove the lower sideband thereof, and which includes provision for an SCA channel at the location of the missing lower sideband. This invention also contemplates a number of systems and methods for decoding a four-channel composite stereo signal having an SCA channel, as described. The preferred systems and methods for decoding the composite stereo signal exploit the general principles of the phasing method of single sideband modulation. Reference will be made to FIG. 17A in connection with a brief description of the phasing method as applied to demodulation, which is essentially the inverse process of modulation.

The FIG. 17A diagram is shown as including balanced modulators 309, 311, analogous to modulators 302, 306 in the FIG. 16 diagram, P-type and N-type phasing networks 313, 315, analogous to the phasing networks 300, 304 in FIG. 16, and an adder 317. As shown by the annotations on the FIG. 17A diagram it can be seen that the audio signal due to the upper sideband is present at the output, but the audio signal due to the lower sideband is cancelled in the adder 317. To simplify the annotations, at the output of the networks 313, 315 the functions of reference carrier $2\omega_c$ have been omitted. It is noted that the signals in the lower sideband region need not have any particular relationship to the upper sideband signals; any arbitrary signal, or even a noise component, at the input occupying the spectrum region of the lower sideband will be cancelled at the output.

Figure 19:
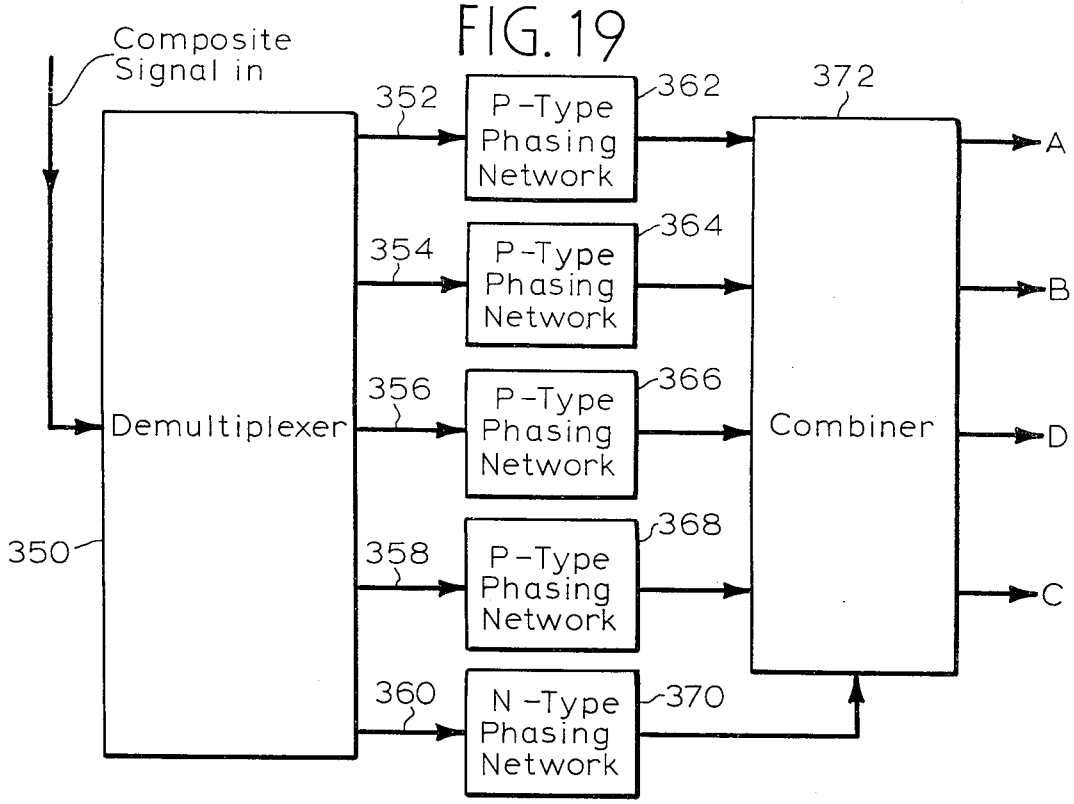
FIG. 19 is a block diagram adumbrating a decoding system for use in a four-channel stereo receiver capable of decoding a four-channel stereo signal as may be transmitted by the FIG. 15 or FIG. 18 transmitters having an SCA signal component.

FIG. 19 illustrates in general block diagram form a demultiplexer 350 receiving a composite four-channel stereo signal as may be developed by a suitable FM demodulator (not shown). In connection with the discussion of the FIG. 19 decoder, and the subsequent discussions of another decoder embodiment shown in FIG. 20, assume the four-channel signal received by the decoder has a preferred form according with the above expression (15), namely;

$$A+B+C+D+\sqrt{2}(A-D)\cos\omega_s t+\sqrt{2}(B-C)\sin\omega_s t + k[(A-B-C+D)\cos 2\omega_s t - (\hat{A}-\hat{B}-\hat{C}+\hat{D})\sin 2\omega_s t]+Y' \quad (15a)$$

where Y′ is an SCA signal located in the region of the lower sideband of the second harmonic sub-carrier.

Let $Y' = Y_m \sin y' t$;

$Y' = Y_m \sin(2\omega_s - y)t$, where $y$ is the argument of the frequency-modulated SCA signal translated down into the audio band.

The demultiplexer 350 is shown as implementing an important aspect of this invention, developing outputs at five output leads 352, 354, 356, 358 and 360, four of which are passed through phasing networks 362, 364, 366, 368 illustrated as being of the P-type, and the fifth of which is passed through a phasing network 370, illustrated as being of the N-type. The outputs from the demultiplexer 350 are recombined in a combiner 372. The demultiplexer 350 may be of a type capable of demultiplexing in either the time or frequency domain, and may, in certain embodiments where appropriate, prepare the developed outputs, as by pre-matrixing, for recombination in the combiner 372.

The combiner 372 comprises a matrixing system for separating the information carried by the five inputs thereto so as to develop four discrete audio output signals A, B, C, and D and to eliminate the SCA signal. The combiner 372 may include in certain embodiments means for adjusting the relative amplitudes of various signals as will become more clear from the following description of specific decoder embodiments.

The FIG. 19 diagram illustrates a novel employment of four P-type phasing networks 362, 364, 366 and 368 and one N-type phasing network 370 to achieve cancellation of the lower sideband of the 76kHz sub-carrier. As will become evident from a description below of specific decoder embodiments employing the phasing method of demodulation, the use of four P-type phasing networks and one N-type phasing network is significant for a number of reasons. First, a minimal number of phasing networks is employed. Secondly, the phasing networks used in the greatest number (the P-type networks) may be of less complex construction. The more complex, higher order N-type network need only be used in one location. It may be useful to note that four P-type networks are used (rather than a single P-type network operating on the demodulated 76kHz sub-carrier components) for the reason that the P-type phase shift introduced in the demodulated 76kHz component of the baseband signal must be preserved for the main channel and demodulated 38kHz signals in order not to distort the crucial phase relationships necessary for proper matrixing of these components in order to achieve separation between the four audio output signals.

Figure 20:
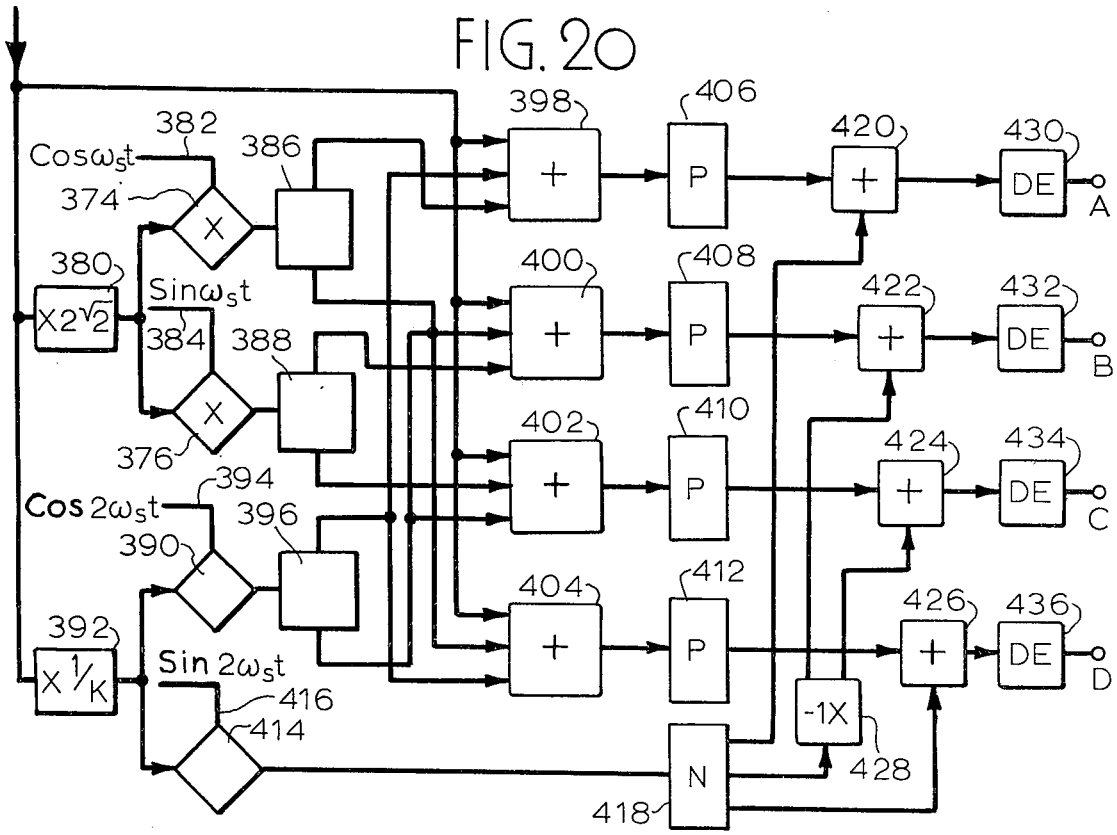
FIGS. 20 and 21 are block diagram representations of alternative receivers employing the "phasing" method for reproducing four-channel stereo information from a transmitted signal having an SCA channel.

FIG. 20 illustrates a four-channel demultiplexing system exploiting the phasing method of single sideband demodulation and operation in the frequency domain. Assume again a received signal as described by expression (15*a*). In the illustrated FIG. 20 system demodulation components are taken off the 38kHz sub-carriers, by means of a pair of balanced demodulators 374, 376 which receive the composite four-channel stereo signal after modification by an amplitude adjustor 380.

A reference signal developed at 382 for injection into the balanced demodulator 374 is derived by the use of the 19kHz pilot signal extracted from the composite stereo signal. The reference signal is preferably caused to have a phas which is effective to detect the (A−D) modulation component of the 38kHz sub-carrier.

A reference signal developed at 384, similarly derived from the 19kHz pilot, is injected into the balanced demodulator 376, but is caused to have a phase effective to detect the (B−C) modulation component of the 38kHz sub-carrier.

The outputs from the balanced demodulators 374 and 376 are fed to phase splitters 386 and 388, respectively. The amplitude attenuator 380 is adjusted such that at the outputs of the phase splitter 386 there is developed signals +2(A−D) and −2(A−D). Similarly, the outputs of phase splitter 388 are +2(B−C) and −2(B−C).

The 76kHz in-phase modulation component is taken from the 76kHz sub-carrier by means of a balanced demodulator 390 receiving at one input the composite stereo signal through an amplitude attenuator 392 and at another input 394 a 76kHz reference carrier.

Balanced modulator 390 receives a reference carrier $\cos 2\omega_s t$, thus demodulating the in-phase second harmonic term (A−B−C+D) and neglecting the quadrature second harmonic term ($\hat{A}-\hat{B}-\hat{C}+\hat{D}$). In the same process the SCA signal Y′, if present, is also demodulated.

The output of balanced modulator 390 due to the $$\frac{1}{k}Y'$$

input is $$\frac{1}{k}Y'\cos 2\omega_s t = \frac{1}{k}Y_m \sin(2\omega_s - y)t \cos 2\omega_s 44\ t\ \frac{1}{2k}Y_m \sin(4\omega_s - y)t$$

$$-\frac{1}{2k}Y_m \sin yt.$$

The second term represents the spectrum in the audio range and may be represented by:

$$-\frac{1}{2k}Y = -\frac{1}{2k}Y_m \sin yt,$$

where $Y$ is defined as $Y_m \sin yt$.

The Hilbert transform of Y can be represented by $\hat{Y} = -Y_m \cos yt$.

The four-channel stereo signal output of demodulator 390 can be represented by $$LF\ \left\{\frac{1}{k}\times k(\hat{A}-\hat{B}-\hat{C}+\hat{D})\cos 2\omega_s t \times \cos 2\omega_s t\right\} =$$

-continued $$\frac{1}{2}(A-B-C+D)$$

[LF{A} means the low frequency (audio) component of A]. The output of the demodulator 414 may be described $$\frac{1}{k}LF\ \{[+k(\hat{A}-\hat{B}-\hat{C}+\hat{D})\ \sin 2\omega_s t + Y']\ \sin 2\omega_s t\} =$$

$$\frac{1}{2}(\hat{A}-\hat{B}-\hat{C}+\hat{D}) + \frac{1}{2k}LF\ \{2Y_m \sin(2\omega_s - y)t \sin 2\omega_s t\} =$$

$$\frac{1}{2}(\hat{A}-\hat{B}-\hat{C}+\hat{D}) - \frac{1}{2k}\hat{Y}$$

The outputs from the 38kHz balanced demodulators 374, 376 and the 76kHz demodulator 390, as well as a main channel signal derived from the incoming composite stereo signal are applied to summing networks 398, 400, 402 and 404. At the output of summing network 398 there is developed the signal $$3\ \frac{1}{2}A + \frac{1}{2k}Y + \frac{1}{2}B + \frac{1}{2}C - \frac{1}{2}D.$$

At the output of summing network 400 there is developed a signal $$3\ \frac{1}{2}B - \frac{1}{2k}Y + \frac{1}{2}A - \frac{1}{2}C \quad \frac{1}{2}D$$

At the output of summing network 402 there appears the signal $$3\ \frac{1}{2}C - \frac{1}{2k}Y + \frac{1}{2}A - \frac{1}{2}B + \frac{1}{2}D.$$

At the output of summing network 404 there is developed a signal $$3\ \frac{1}{2}D + \frac{1}{2k}Y - \frac{1}{2}A + \frac{1}{2}B + \frac{1}{2}C.$$

The output signals from the summing networks 390, 400, 402 and 404 are supplied to like P-type phase shifting networks 406, 408, 410 and 412, respectively. The P-type phase shifting networks cause the signals operated on to have a predetermined phase-versus-frequency characteristic over the audio band (approximately 50Hz − 15kHz).

In order to effect cancellation of the information in the location of the lower sideband of the 76kHz sub-carrier, i.e. the SCA signal, a quadrature demodulation component on the 76kHz sub-carrier is derived by means of a second balanced demodulator 414 receiving at input 416 a 76kHz reference carrier, $\sin 2\omega_s t$, developed from the transmitted pilot signal, having a phase which is 90° displaced from the reference signal 394, i.e. $\cos 2\omega_s t$, injected into the demodulator 390. The output of the demodulator 414 may be described as the Hilbert transform of the signal derived from the modulator 390, that is, $$\frac{1}{2}(\hat{A}-\hat{B}-\hat{C}+\hat{D}) - \frac{1}{2k}\hat{Y}.$$

The output from the balanced demodulator 414 is fed to an N-type phase shifting network 418 to develop a signal $$\frac{1}{2}(A-B-C+D) - \frac{1}{2k}Y.$$

This signal developed by the 76kHz demodulator 414 is combined with the output signals from the P-type phase shifting networks 406, 408, 410, 412 by means of adders 420, 422 424 and 426 and a signal inverter 428.

At the output of adders 420, 422, 424, 426 there is developed four discrete audio signals which are supplied to de-emphasizing means 430, 432, 434 and 436 to produce four audio output signals corresponding to the four audio input signals received by the encoding apparatus at the signal transmitter.

Figure 21:
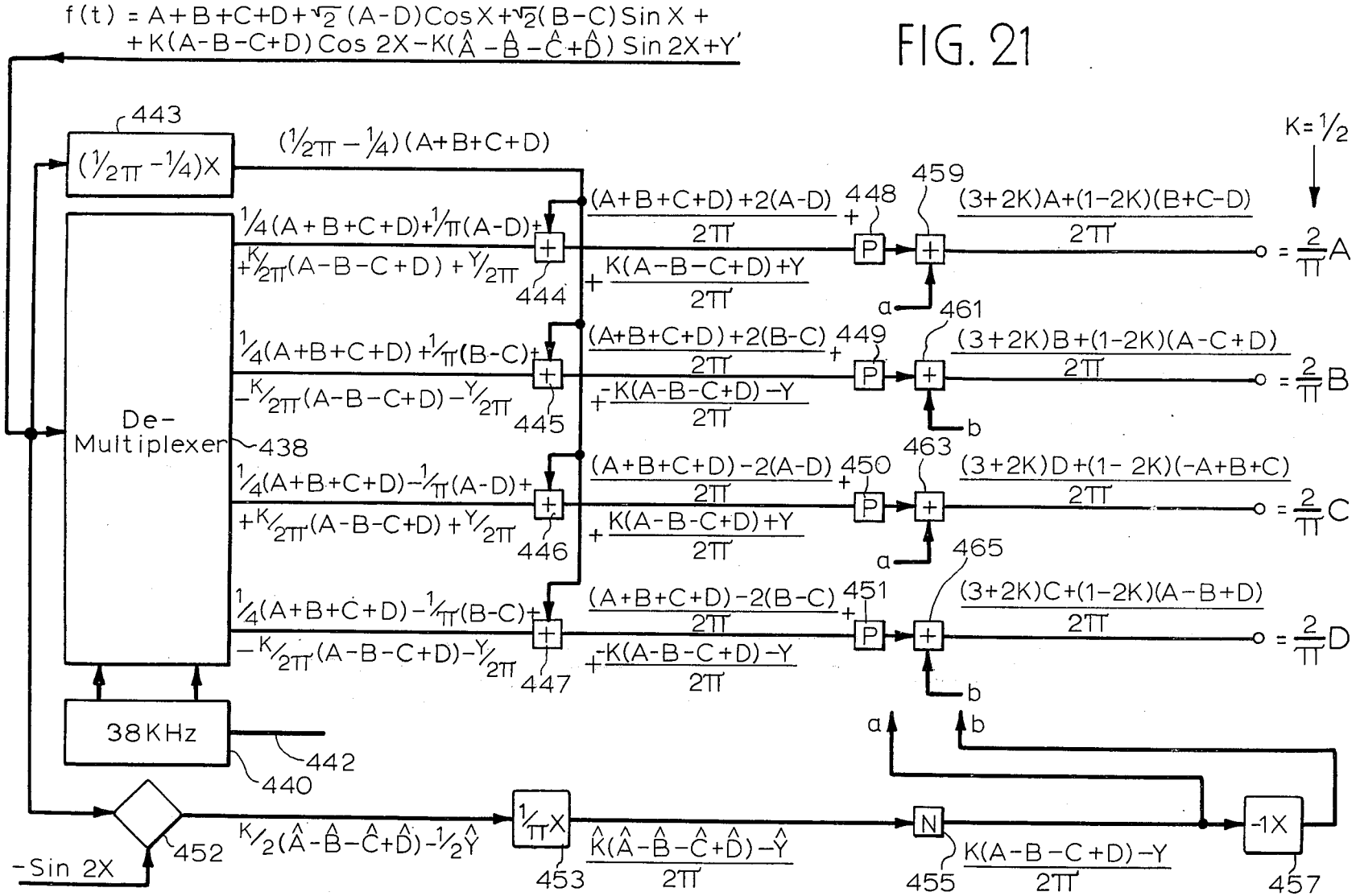

FIG. 21 illustrates a system which also exploits the described phasing method of single sideband demodulation but which utilizes time-division demultiplexing rather than frequency-division demultiplexing. In the FIG. 21 system the composite stereo signal is applied to a time-division demultiplexer 438 in which the incoming signal is sampled at a 76kHz rate. This rate is established with the aid of two 38kHz signals which are in quadrature with each other and which are derived from the 19kHz pilot signal. The demultiplexer 438 is controlled by a switching controller 440 driven by a 38kHz timing signal applied at 442 which is derived from the 19kHz pilot. The switching function developed by the controller 440 may be described as follows:

$$S_1 = \frac{1}{4} + \frac{\sqrt{2}}{\pi}\cos\omega_s t + \frac{1}{\pi}\cos\omega_s\ t$$

$$S_2 = \frac{1}{4} + \frac{\sqrt{2}}{\pi}\sin\omega_s t - \frac{1}{\pi}\cos\omega_s\ t$$

$$S_3 = \frac{1}{4} - \frac{\sqrt{2}}{\pi}\cos\omega_s t + \frac{1}{\pi}\cos\omega_s\ t$$

$$S_4 = \frac{1}{4} - \frac{\sqrt{2}}{\pi}\sin\omega_s t - \frac{1}{\pi}\cos\omega_s\ t,$$

where $\omega_s = 2\omega_s$.

The input signal $f(t)$ can be described as:

$$f(t) = A+B+C+D + \sqrt{2}(A-D)\cos\omega_s t + \sqrt{2}(B-C)\sin\omega_s t + \tfrac{1}{2}(A-B-C+D)\cos 2\omega_s t - \tfrac{1}{2}(\hat{A}-\hat{B}-\hat{C}+\hat{D})\sin 2\omega_s t + Y'.$$

The presence of the coefficient ½ in the second harmonic sub-carrier terms will be explained below. Note also that the time-multiplex related form of the upper sideband of the second harmonic sub-carrier, as described by expression (11) is used, rather than the better interleaved form described by expression (15).

The four sampled output signals $v_i$ ($i$=1, 2, 3, 4) can be represented by:

$$v_i = LF\{f(t)xS_i\} \quad i=1, 2, 3, 4$$

$$v_1 = \left(\frac{1}{4} + \frac{5}{4\pi}\right)A + \left(\frac{1}{4} - \frac{1}{4\pi}\right)B + \left(\frac{1}{4} - \frac{1}{4\pi}\right)C - \left(\frac{3}{4\pi} - \frac{1}{4}\right)D + \frac{1}{2\pi}Y$$

$$v_2 = \left(\frac{1}{4} - \frac{1}{4\pi}\right)A + \left(\frac{1}{4} + \frac{5}{4\pi}\right)B - \left(\frac{3}{4\pi} - \frac{1}{4}\right)C + \left(\frac{1}{4} - \frac{1}{4\pi}\right)D - \frac{1}{2\pi}Y$$

$$v_3 = -\left(\frac{3}{4\pi} - \frac{1}{4}\right)A + \left(\frac{1}{4} - \frac{1}{4\pi}\right)B + \left(\frac{1}{4} - \frac{1}{4\pi}\right)C + \left(\frac{1}{4} + \frac{5}{4\pi}\right)D + \frac{1}{2\pi}Y$$

$$v_4 = \left(\frac{1}{4} - \frac{1}{4\pi}\right)A - \left(\frac{3}{4\pi} - \frac{1}{4}\right)B + \left(\frac{1}{4} + \frac{5}{4\pi}\right)C + \left(\frac{1}{4} - \frac{1}{4\pi}\right)D - \frac{1}{2\pi}Y$$

It can be seen that in the signals $v_i$ ($i$=1, 2, 3, 4), A, B, D and C, respectively are represented predominantly, but not exclusively. To eliminate Y according to the phasing method, a portion of the output of a 76kHz quadrature demodulator is mixed with the demultiplexer output. In this process of eliminating Y, however, portions of A, B, C and D are added. The signals $v_i$ thus have to be preconditioned so that the like unwanted terms are present in the signals but with signs opposite to those in the 76kHz quadrature demodulated signal. This preconditioning is performed in a first matrix network 443 developing a signal $v_m$ which is fed to adders 444, 445, 446, 447.

In the illustrated embodiment, $$v_m = \left(\frac{1}{2\pi} - \frac{1}{4}\right)(A+B+C+D).$$

Let the outputs of the adders 444-447 be represented by $$v_{ii} = v_i + v_m \quad (i=1, 2, 3, 4).$$

Then $$v_{11} = \left(\frac{1}{2\pi} \quad 3\frac{1}{2}A\right) + \frac{1}{2\pi}\left(\frac{1}{2}B\right) + \frac{1}{2\pi}\left(\frac{1}{2}C\right) - \frac{1}{2\pi}\left(\frac{1}{2}D\right) + \frac{1}{2\pi}Y$$

$$v_{22} = \left(\frac{1}{2\pi} \quad \frac{1}{2}A\right) + \frac{1}{2\pi}\left(3\frac{1}{2}B\right) - \frac{1}{2\pi}\left(\frac{1}{2}C\right) + \frac{1}{2\pi}\left(\frac{1}{2}D\right) - \frac{1}{2\pi}Y$$

$$v_{33} = -\left(\frac{1}{2\pi} \quad \frac{1}{2}A\right) + \frac{1}{2\pi}\left(\frac{1}{2}B\right) + \frac{1}{2\pi}\left(\frac{1}{2}C\right) + \frac{1}{2\pi}\left(3\frac{1}{2}D\right) + \frac{1}{2\pi}Y, \text{ and}$$

$$v_{44} = \left(\frac{1}{2\pi} \quad \frac{1}{2}A\right) - \frac{1}{2\pi}\left(\frac{1}{2}B\right) + \frac{1}{2\pi}\left(3\frac{1}{2}C\right) + \frac{1}{2\pi}\left(\frac{1}{2}D\right) - \frac{1}{2\pi}Y.$$

The signals $v_{ii}$ are supplied to like phasing means 448, 449, 450 and 451 of the P-type. It will now be seen that the subsequent addition of a portion of the quadrature demodulator output signal will precisely eliminate the Y as well as the undesired stereo signals.

A 76kHz quadrature demodulator 452 is driven by f(t) and by a carrier signal $-\sin 2\omega_s t$. Its output, ¼ $(\hat{A}-\hat{B}-\hat{C}+\hat{D})$ −½ $\hat{Y}$, is attenuated in amplitude controller 453 and passed through N-type phasing means 455. The ouput of the phasing means 455 is represented by $$v_n = \left(\frac{1}{2\pi}\right)\frac{1}{2}(A-B-C+D) - \frac{1}{2\pi}Y.$$

An inverter 457 makes minus $v_n$ also available. In adders 459, 461, 463 and 465 the following signals are generated:

$$v_5 = v_{11} + v_n = \frac{2}{\pi}A$$

$$v_6 = v_{22} - v_n = \frac{2}{\pi}B$$

$$v_7 = v_{33} + v_n = \frac{2}{\pi}D$$

$$v_8 = v_{44} - v_n = \frac{2}{\pi}C,$$

respectively.

A careful analysis of the signal processing in FIG. 21 will show that any multiplier other than 0.5 in the second harmonic sub-carrier of the input signal will not achieve both elimination of the SCA signal Y and total separation of the A, B, C and D audio signals.

Thus it is shown that for certain forms of the four-channel stereo baseband signal including SCA, the time demultiplexing form of decoding such a four-channel stereo signal is feasible.

Figure 22:
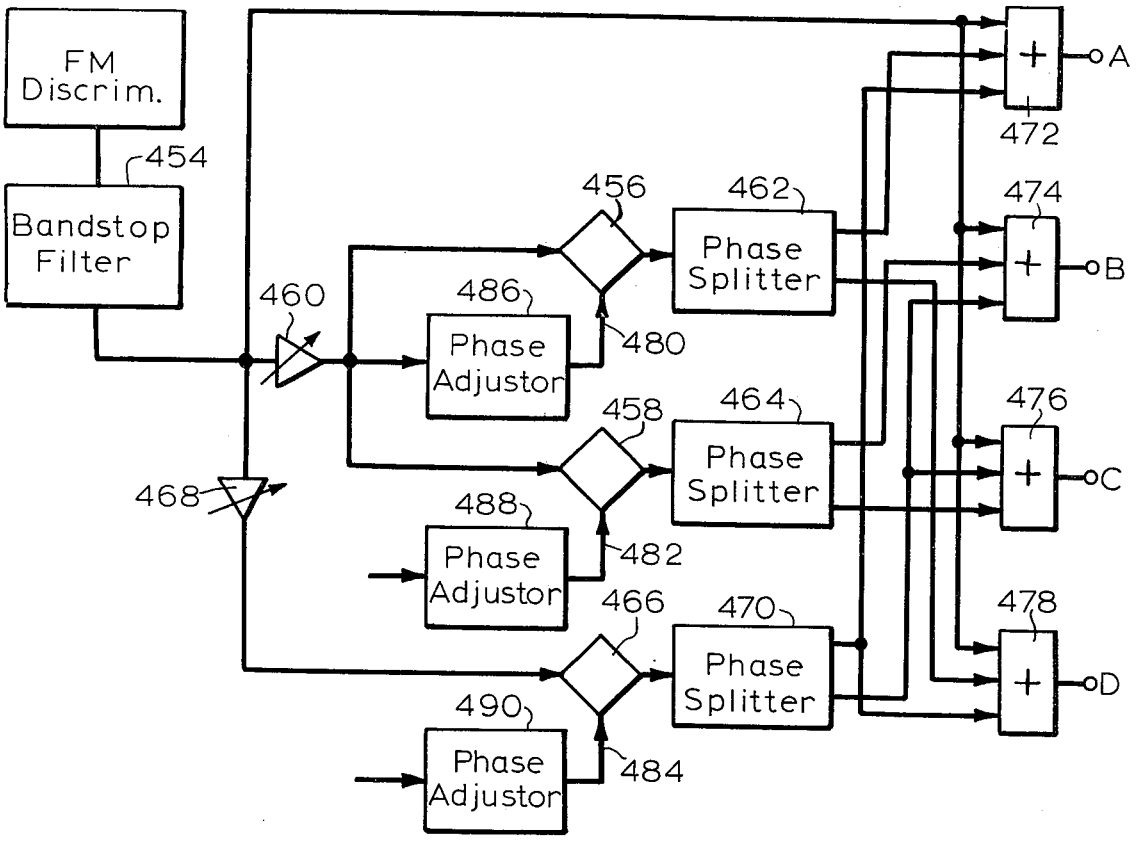
FIG. 22 depicts in block diagram form a four-channel stereo receiver embodiment which employs a bandstop filter and frequency division multiplexing to achieve single sideband demodulation.

As noted above, whereas the described phasing method of single sideband modulation and/or demodulation is preferred, other methods for achieving single sideband modulation and/or demodulation are contemplated. FIG. 22 depicts a system for decoding a composite four-channel stereo signal which includes an SCA channel in the location of the lower sideband of the 76kHz sub-carrier, and which employs a bandstop filter to remove the SCA channel. FIG. 22 illustrates a decoding system which is similar in many respects to the FIG. 20 decoding system, but which employs a bandstop filter 454 to remove the SCA signal, rather than employing N and P phasing networks to achieve cancellation of the said lower sideband. As in the FIG. 20 system, the FIG. 22 system employs a pair of balanced demodulators 456 and 458 receiving the composite stereo signal after appropriate amplitude adjustment means 460 and subsequently demodulating the first harmonic sub-carrier. The outputs from the demodulators 456, 458 are supplied to phase splitters 462 and 464 to make available positive and negative versions of the output signals from each of the demodulators 456 and 458.

In order to demodulate the 76kHz sub-carrier, a balanced demodulator 466 is provided which receives as an input the composite stereo signal after appropriate amplitude adjustment in an amplifier 468. The balanced demodulator 466 corresponds to the demodulator 414 in the FIG. 20 system. The output from the demodulator 468 is supplied to a phase splitter 470. As in the FIG. 20 system the outputs from the phase splitters 462, 464 and 470, along with a main channel component derived from the composite stereo signal are fed to adders 472, 474, 476 and 478. At the output of the adders are developed four discrete audio output signals A, B, C and D. In order to effect complete separation of the four audio output signals, the attenuator 460 is adjusted such that the outputs from the balanced demodulators 456, 458 represent the signals 2(A–D) and 2(B–C), respectively. The amplifier 468 is adjusted such that the output from the balanced demodulator 466 yields a signal ½ (A+D–C–B).

It is well known that bandstop filters cause phase shifts of the non-attenuated signal components adjacent to the stop band. In the present application the phase-distorted signals are mainly in the upper sideband of the first harmonic sub-carrier and the upper sideband of the second harmonic sub-carrier. These phase shifts cause, in general, a frequency dependent lack of separation in the four decoder audio outputs. This separation can be improved by adjusting the phase of the carriers 480, 482 and 484 injected into the demodulators 456, 458, 466, by means of phase adjustors 486, 488 and 490, respectively. In this manner acceptable amounts of separation of A, B, C and D can be obtained.

There have been discussed above a number of embodiments of four-channel stereo encoding and decoding systems which develop the favored four-channel stereo multiplexed signal having an upper sideband only on the 76kHz sub-carrier. By way of summarization and in order to more particularly point out the features and unique characteristics of certain aspects of this invention, there are stated below specifications for the preferred form of the composite four-channel stereo signal. By way of introduction, it is useful to restate the composite stereo signal form as expressed in (15) but expanded to include the SCA and pilot signals:

$$f(t) = M+S \sin(\omega_s/2 \quad t+3\pi/8)+K_1 \sqrt{2}(A-D-) \cos\omega_s t+K_1 \sqrt{2}(B-C)$$

$$\sin\omega_s t-T\cos 2\omega_s t+U\cos 2\omega_s t-\hat{U}\sin 2\omega_s t+V\cos\Omega t, \qquad (16)$$

where the four audio input signals are:

$A$=left-front, $C$=left-back, $B$=right-front, and $D$=right-back;

$M=K_1(A+B+C+D)=K_1(L+R)$;

$S$=0.1, the amplitude of the 19kHz pilot sub-carrier;

$T$=0.05, the amplitude of the second pilot sub-carrier at 76kHz;

$U=K_2(A+D-B-C)$, the diagonal difference signal;

$\hat{U}=K_2(\hat{A}+\hat{D}-\hat{B}-\hat{C})$, the Hilbert transform of U;

$V$=0.1, amplitude of the SCA FM sub-carrier at a nominal center frequency of 67kHz;

$K_1$=0.75; $K_2$=0.75$K_3$ (with $V$=0, $K_1$=0.85, $K_2$=0.85$K_3$); and $K_3$=0.7 (approximately).

The baseband signal, $f(t)$ has a maximum value of unity at any instant.

In order to better illustrate the compatibility of the composite signal expression (16) with the expression for two-channel stereo 1, the following transformation may be applied to the expression (16):

$$\omega_s t = \omega_i t - \tfrac{3}{4}\pi$$

The transformation constitutes merely a shift in the time axis and thus $\omega_i t$ can be replaced again by $\omega_s t$. This leads to:

$$f(t)=M+S\sin \omega_s/2 \quad t+P\sin\omega_s t-Q\cos\omega_s t \quad +T\sin 2\omega_s t- -U\sin 2\omega_s t-\hat{U}\cos 2\omega_s t +V\cos\Omega t, \qquad (17)$$

where $P=K_1(A+D-B-C)=K_1$ (Left minus Right), and $Q=K_1(A+B-D-C)=K_1$ (Front minus Back).

A comparison of expression (17) with expression (1) for two-channel stereo communication clearly reveals the compatibility of the four-channel systems of this invention with present two-channel stereophony.

There follows an elaborated description of the preferred form of the composite four-channel stereo signal according to this invention.

The main channel component consists of the sum (A+C+B+D) of the left-front, left-back, right-front, and right-back four channel input signals, respectively. The main channel frequency modulates the main carrier 85% (excluding the SCA sub-carrier).

The pilot sub-carrier at 19kHz frequency modulates the main carrier 10%.

The first 38kHz sub-carrier, $\sin\omega_s t$, is the second harmonic of the 19kHz pilot sub-carrier and crosses the time axis with a positive slope (increasing main carrier frequency) simultaneously with each crossing of the time axis by the 19kHz pilot sub-carrier. The first 38kHz sub-carrier and its sidebands signal is the modulated 38kHz sub-carrier double sideband, suppressed carrier, amplitude mmodulated by a four-channel input signal, [(A+C) −(B+D)], which corresponds to a two-channel, left minus right (L–R) input signal. The first 38kHz sub-carrier and its sidebands signal frequency modulates the main carrier 85% (excluding the SCA sub-carrier).

The second 38kHz sub-carrier, $\cos\omega_{sc} t$ is the second harmonic of the 19kHz pilot sub-carrier and is in quadrature with the first 38kHz sub-carrier. The second 38kHz sub-carrier causes an upward peak deviation of the main carrier frequency each time the 19kHz pilot sub-carrier crosses the time axis. The second 38kHz sub-carrier and its sidebands signal is the second 38kHz sub-carrier double sideband, suppressed carrier, amplitude modulated by a four-channel, front minus back input signal, [(A+B) −(C+D)]. The second 38kHz sub-carrier and its sidebands signal frequency modulates the main carrier 85% (excluding the SCA sub-carrier).

The 76kHz sub-channel is a 76kHz sub-carrier which is upper single sideband, suppressed carrier, amplitude modulated by [(A+D) −(B+C)], which is a diagonal difference four-channel input signal component. The 76kHz sub-channel frequency modulates the main carrier 85×0.7=59.5% (excluding the SCA sub-carrier). The 76kHz sub-channel consists of a first and a second 76kHz component. The first 76kHz sub-channel component results from modulating a first 76kHz sub-carrier and the second component from modulating a second 76kHz sub-carrier. The first 76kHz sub-carrier, $\sin 2\omega_s t$, is the fourth harmonic of the 19kHz pilot sub-carrier with the condition that each time the 19kHz pilot sub-carrier crosses the time axis, the first 76kHz sub-carrier crosses the time axis simultaneously with a positive slope (increasing main carrier frequency). The first 76 kHz sub-carrier is double sideband, suppressed carrier, amplitude modulated by the four-channel diagonal difference input signal, [(A+D)−(B+C)], the result of which modulation is the first 76 kHz sub-carrier and its sidebands signal.

The second 76 kHz sub-carrier, $\cos 2\omega_s t$, is the fourth harmonic of the 19 kHz pilot sub-carrier with the condition that each time the 19 kHz sub-carrier crosses the time axis, the second 76 kHz sub-carrier causes an upward peak deviation of the main carrier. The second 76 kHz sub-carrier is double sideband, suppressed carrier, amplitude modulated by the Hilbert transform of the four-channel diagonal difference input signal, namely, [(A+D)−(B+C)], the result of which modulation is the second 76 kHz sub-carrier and its sidebands signal.

The 76 kHz pilot sub-carrier, $\sin 2\omega_s t$, is the fourth harmonic of the 19 kHz pilot sub-carrier with the condition that each time the 19 kHz pilot sub-carrier crosses the time axis, the 76 kHz pilot sub-carrier crosses the time axis simultaneously with a positive slope (increasing main carrier frequency). The 76 kHz pilot sub-carrier causes a 5% deviation of the main carrier.

The SCA component is a frequency modulated sub-carrier at a nominal center frequency of 67 kHz and modulates the main carrier 10%. When the SCA sub-channel is broadcast, the main channel the first 38 kHz sub-carrier plus its sidebands signal, the second 38 kHz sub-carrier plus its sideband signal modulate the main carrier 75% while the 76 kHz sub-channel modulates the main carrier 75×0.7=52.5%.

The peak deviation of the main carrier resulting from simultaneous modulation by the main channel, the first 38 kHz sub-carrier and its sidebands signal, the second 38 kHz sub-carrier and its sidebands signal, the 76 kHz sub-channel, the 19 kHz pilot sub-carrier, the SCA sub-channel, and the 76 kHz pilot sub-carrier is 100% of total modulation.

The pre-emphasis characteristics of all of the sub-carrier channels are identical with those of the main channel (standard 76 microseconds).

The main channel and all sub-channels are capable of accepting audio frequencies from 50 to 15,000Hz.

When only equal positive left-front and left-back signals are applied, the main channel modulation causes an upward deviation of the main carrier frequency; also the first 38kHz sub-carrier and its sidebands signal crosses the time axis simultaneously with the first 38kHz sub-carrier and in the same direction.

When only equal positive left-front and right-front signals are applied, the main channel modulation causes an upward deviation of the main carrier frequency; also crosses second 38kHz sub-carrier and its sidebands signal ccrosses the time axis simultaneously with the 38kHz sub-carrier and in the opposite direction.

When only equal positive left-front and right-back diagonal signals are applied, the main channel modulation causes an upward deviation of the main carrier frequency; also the first 76kHz sub-carrier and its sidebands signal crosses the time axis simultaneously with the first 76kHz sub-carrier in the opposite direction.

When only equal and increasing left-front and right-back diagonal signals are applied, the main channel modulation causes an increasing main carrier frequency; also the second 76kHz sub-carrier and its sidebands signal crosses the time axis simultaneously with the second 76kHz sub-carrier and in the same direction.

The invention is not limited to the particular details of construction of the embodiments depicted and other modifications and applications are contemplated. For example, the described method and structure for minimizing the maximum amplitude of the baseband four-channel stereo signal when 38kHz and 76KHz signals are present simultaneously, and thus the maximum amplitude of the composite signal including the SCA and pilot signals under the same conditions, so as to minimize the maximum frequency deviation of the RF carrier also under those same conditions has been discussed in terms of its applicability to four-channel FM stereo communication, it has general applicability to any communication system employing harmonically related sub-carriers which are amplitude-modulated, either double or single-sideband.

While particular embodiments of the present invention have been shown and described, it is apparent that changes and modifications may be made therein without departing from the invention in its broader aspects. The aim of the appended claims, therefore, is to cover all such changes and modifications as fall within the true spirit and scope of the invention.

What is claimed is:

1. A four-channel stereo receiver for developing four discrete audio signals from a transmitted composite stereo signal frequency-modulating an RF carrier, which composite signal effectively includes in the frequency domain at least the following components;

a four-element sum component representing the sum of four input audio signals individually representative of first, second, third and fourth audio sources located, respectively, at the left-front, right-front, left-rear and right-rear of a listening point, a first two-element difference component representing a difference between the elements of a diagonally related first pair of said input audio signals modulating a first sub-carrier of angular frequency $\omega_s$, a second two-element difference component representing a difference between the elements of a diagonally related second pair of said input audio signals modulating a second sub-carrier of angular frequency $\omega_s$ but displaced in phase, relative to the phase of said first sub-carrier, by 90°, a four-element diagonal difference component representing a difference between the sum of said first pair of audio signal elements and the sum of said second pair of audio signal elements modulating a third sub-carrier of angular frequency $2\omega_s$, a Hilbert transform of said four-element difference component modulating a fourth sub-carrier of angular frequency $2\omega_s$ in quadrature with said third sub-carrier which in combination with said modulated third sub-carrier effectively cancels the lower sideband of said third and fourth sub-carriers, and a pilot signal having an angular frequency $\omega_s/2$ and a phase which is such that the phase of the second harmonic thereof is effectively displaced in phase, relative to the phase of said first sub-carrier, by 45°, said four-channel receiver comprising:

discriminator means for demodulating said composite signal from said RF carrier;

decoding means receiving said composite signal and responsive to said pilot signal for effectively removing from said first and second sub-carriers, respectively, first and second demodulation components disposed in quadrature and related to said first and second two-element difference components, and for effectively removing from said third and fourth sub-carriers, respectively, third and fourth demodulation components also disposed in quadrature, said third demodulation component comprising said four-element diagonal difference component and said fourth demodulation component comprising a Hilbert transform of said four-element difference component;

matrixing means responsive to said first, second and third demodulation components and to said sum component of said composite stereo signal for producing four modified demodulation components adapted for subsequent signal separation matrixing with said fourth demodulation component;

first phasing means responsive to said four modified demodulation components for effecting a first predetermined phase-vs-frequency characteristic of said four modified demodulation components over a predetermined band of frequencies;

second phasing means responsive to said fourth demodulation component for effecting a second predetermined phase-vs-frequency characteristic of said fourth demodulation component, over said predetermined band, said second phasing means effectively introducing a substantially 90° phase shift of said fourth demodulation component relative to said four modified demodulation components over said predetermined band; and second matrixing means for combining said phase shifted four modified demodulation components and said phase shifted fourth demodulation component so as to produce four discrete output audio signals corresponding to said four input audio signals.

2. A receiver of the type defined by claim 1 wherein said first phasing means comprises four P-type phase shifting networks, and wherein said second phasing means comprises one N-type phase shifting network.

3. A receiver of the type defined by claim 1 which includes means for developing from said pilot signal first and second quadrature reference signals of angular frequency $\omega_s$ and third and fourth quadrature reference signals of angular frequency $2\omega_s$, and wherein said decoding means includes first and second balanced demodulator means receiving as inputs said first and second quadrature reference carriers of frequency $\omega_s$ for removing from said first and second sub-carriers said first and second demodulation components, and wherein said decoding means includes third and fourth balanced demodulator means having as inputs said third and fourth quadrature reference carriers of frequency $2\omega_s$ for removing from said third and fourth sub-carriers said third and fourth demodulation components.

4. A receiver of the type defined by claim 1 wherein said decoding means includes four-phase gating means for deriving said first, second, third and fourth demodulation components.

5. A receiver of the type defined by claim 1 wherein said decoding means includes first two-phase gating means operating at a rate of $\omega_s$ for deriving said first and second demodulation components, and second two-phase gating means operating at a rate of $2\omega_s$ for deriving said third and fourth demodulation components.

6. A method of four-channel stereo communication, comprising:

developing four input audio signals individually representative of first, second, third and fourth audio sources located, respectively, at the left-front, right-front, left-rear and right-rear of a listening point and characterizing an acoustic image;

combining said four input audio signals so as to develop a composite four-channel stereo signal including in the frequency domain at least the following components;

a four-element sum component representing the sum of said four input audio signals, a first two-element difference component representing a difference between the elements of a diagonally related first pair of said input audio signals modulating a first sub-carrier of angular frequency $\omega_s$, a second two-element difference component representing a difference between the elements of a diagonally related second pair of said input audio signals modulating a second sub-carrier of angular frequency $\omega_s$ but displaced in phase, relative to the phase of said first sub-carrier, by 90°, a four-element diagonal difference component representing a difference between the sum of said first pair of audio signal elements and the sum of said second pair of audio signal elements modulating a third sub-carrier of angular frequency $2\omega_s$, and a Hilbert transform of said four-element difference component modulating a fourth sub-carrier of angular frequency $2\omega_s$ in quadrature with said third sub-carrier which in combination with said modulated third sub-carrier effectively cancels the lower sideband of said third and fourth sub-carriers;

generating a pilot signal of frequency $\omega_s/2$ the second harmonic of which is caused to have a phase which is effectively displaced in phase, relative to the phase of said first sub-carrier, by 45°;

selectively generating an SCA signal modulating a fifth sub-carrier of angular frequency $\omega_{sca}$ located in the spectrum space of the missing sideband of said third and fourth sub-carriers;

frequency modulating an RF carrier with said composite stereo signal and said pilot signal;

transmitting said RF carrier;

receiving and demodulating said RF carrier to derive said composite stereo signal and said pilot signal;

utilizing said pilot signal for decoding said composite signal to effectively remove from said first and second sub-carriers, respectively, first and second demodulation components disposed in quadrature and related to said first and second two-element difference components and to effectively remove from said third and fourth sub-carriers, respectively, third and fourth demodulation components also disposed in quadrature, said third demodulation component comprising said four-element diagonal difference component and the SCA information and said fourth demodulation component comprising a Hilbert transform of both said four-element difference component and the SCA information;

matrixing said first, second and third demodulation components derived by said decoding process and said sum component of said composite signal to produce four modified demodulation components adapted for subsequent signal separation matrixing with said fourth demodulation component;

producing a first predetermined phase-vs-frequency characteristic of said four modified demodulation components over a predetermined band of audio frequencies;

producing a second predetermined phase-vs-frequency characteristic of said fourth demodulation component over said predetermined band to introduce a substantially 90° phase shift of said fourth demodulation component relative to said four modified demodulation components over said predetermined band; and combining said phase shifted four modified demodulation components and said phase shifted fourth demodulation component so as to remove said SCA signal and produce four discrete output audio signals corresponding to said four input audio signals.

7. Apparatus for accepting four input audio signals individually representative of first, second, third and fourth audio sources located, respectively, at the left-front, right-front, left-rear and right-rear of a listening point and characterizing an acoustic image and an SCA signal and for developing from said audio signals a composite four-channel stereo signal which is compatible with monaural and two-channel stereo receivers and which includes an SCA channel, said apparatus comprising:

encoding means for combining said four input audio signals to develop a stereo signal effectively including in the frequency domain at least the following components;

a four-element sum component representing the sum of said four input audio signals, a first two-element difference component representing a difference between the elements of a diagonally related first pair of said input audio signals modulating a first sub-carrier of angular frequency $\omega_s$, a second two-element difference component representing a difference between the elements of a diagonally related second pair of said input audio signals modulating a second sub-carrier of frequency $\omega_s$ but displaced in phase, relative to the phase of said first sub-carrier, by 90°, and a four-element diagonal difference component representing a difference between the sum of said first pair of audio signal elements and the sum of said second pair of audio signal elements single sideband modulating a third sub-carrier of angular frequency $2\omega_s$;

means for developing an SCA signal modulating a fourth sub-carrier of angular frequency $\omega_{sca}$ located in the spectrum space of the missing sideband of said third sub-carrier; and means for developing a pilot signal having an angular frequency $\omega_s/2$ and a phase which is such that the phase of the second harmonic thereof is effectively displaced in phase relative to the phase of said first sub-carrier, by 45°.

8. Apparatus for accepting four input audio signals representative of first, second, third and fourth audio sources located at the left-front, right-front, left-rear and right-rear of a listening point and characterizing an acoustic image and an SCA signal and for developing from said signals a composite four-channel stereo signal which is compatible with monaural and two-channel stereo receivers and which includes an SCA channel, comprising:

encoding means for combining said four input audio signals to develop a stereo signal effectively including in the frequency domain at least the following components;

a four-element sum component representing the sum of said four input audio signals, a first two-element difference component representing a difference between the elements of a diagonally related first pair of said input audio signals modulating a first sub-carrier of angular frequency $\omega_s$, a second two-element difference component representing a difference between the elements of a diagonally related second pair of input audio signals modulating a second sub-carrier of angular frequency $\omega_s$ but displaced in phase, relative to the phase of said first sub-carrier, by 90°, and a four-element diagonal difference component representing a difference between the sum of said first pair of audio signal elements and the sum of said second pair of audio signal elements modulating a third sub-carrier of angular frequency $2\omega_s$;

first phasing means for effecting a first predetermined phase-vs-frequency characteristic of said stereo signal components over a predetermined band of frequencies;

means responsive to said four input audio signals for developing an auxiliary four-element diagonal difference signal corresponding to said four-element diagonal difference signal component of said stereo signal;

second phasing means receiving said auxiliary diagonal difference signal for impressing thereon a second predetermined phase-vs-frequency characteristic effective to introduce a substantially 90° phase shift of said auxiliary diagonal difference signal, relative to said four-element diagonal difference component, over said predetermined frequency band;

means for impressing said auxiliary difference signal upon an auxiliary sub-carrier of angular frequency $2\omega_s$ which is phase-displaced in a predetermined direction by 90° from said third sub-carrier modulated by said four-element diagonal difference component of said stereo signal;

means for combining said auxiliary sub-carrier modulated by said auxiliary four-element difference signal with said stereo signal to produce a modified stereo signal in which a selected one of the sidebands of said third sub-carrier is cancelled;

means for impressing said SCA signal on a fourth sub-carrier of angular frequency $\omega_{sca}$ located in the spectrum space of the missing sideband of said third sub-carrier;

means for developing a pilot signal having an angular frequency $\omega_s/2$ the second harmonic of which is effectively displaced, in phase, relative to the phase of said first sub-carrier, by 45°; and means for combining said modified stereo signal, said carrier-modulating SCA signal, and said pilot signal to produce a composite four channel stereo signal.

9. Apparatus of the type defined by claim 8 wherein said encoding means comprises means for frequency division multiplexing said four input audio signals to develop said stereo signal.

10. Apparatus of the type defined by claim 8 wherein said encoding means comprises means for time division multiplexing said four input audio signals to develop said stereo signal, and includes means for equalizing the amplitude level of said four-element sum component with the amplitude of said third sub-carrier.

11. A method for processing four input audio signals representative of first, second, third and fourth audio sources located at the left-front, right-front, left-rear and right-rear of a listening point and characterizing an acoustic image and an SCA signal to develop a composite four-channel stereo signal which is compatible with monaural and two-channel stereo receivers and which includes an SCA channel, said method comprising:

impressing on said four input audio signals, over a predetermined band of audio frequencies, a predetermined first phase-vs-frequency characteristic;

combining said four input audio signals to develop a stereo signal effectively including in the frequency domain at least the following components;

a four-element sum component representing the sum of said four input audio signals, a first two-element difference component representing a difference between the elements of a diagonally related first pair of said input audio signals modulating a first sub-carrier of angular frequency $\omega_s$, a second two-element difference component representing a difference between the elements of the diagonally related second pair of input audio signals modulating a second sub-carrier of angular frequency $\omega_s$ but displaced in phase, relative to the phase of said first sub-carrier, by 90°, and a four-element diagonal difference component representing a difference between the sum of said first pair of audio signal elements and the sum of said second pair of audio signal elements modulating a third sub-carrier of angular frequency $2\omega_s$;

developing from said four input audio signals an auxiliary four-element diagonal difference signal corresponding to said four-element diagonal difference signal component of said stereo signal;

impressing upon said auxiliary difference signal a predetermined second phase-vs-frequency characteristic effective to introduce over said predetermined band of frequencies a substantially 90° phase shift of said auxiliary difference signal relative to said four-element difference component;

impressing said auxiliary difference signal upon an auxiliary carrier of angular frequency $2\omega_s$ which is phase displaced by 90° from said third sub-carrier carrying said four-element difference component of said stereo signal;

combining said auxiliary carrier modulated by said auxiliary difference signal with said stereo signal to produce a modified stereo signal in which a selected one of the sidebands of said third sub-carrier is removed;

impressing an SCA signal on a fourth sub-carrier of frequency $\omega_{sca}$ located in the spectrum space of the missing sidebands of said third sub-carrier;

developing a pilot signal having an angular frequency $\omega_s/2$ and a phase which is such that the phase of the second harmonic thereof is effectively displaced, relative to the phase of said first sub-carrier component by 45°; and combining said modified stereo signal, said SCA signal, and said pilot signal to form a composite four channel stereo signal.

12. A four-channel stereo receiver for developing four discrete audio signals from a transmitted composite stereo signal frequency-modulating an RF carrier which effectively includes in the frequency domain at least the following components;

a four-element sum component representing the sum of four input audio signals which signals are representative of first, second, third and fourth audio sources located at the left-front, right-front, left-rear and right-rear of a listening point, a first two-element difference component representing a difference between the elements of a diagonally related first pair of said input audio signals modulating a first sub-carrier of angular frequency $\omega_s$, a second two-element difference component representing a difference between the elements of a diagonally related second pair of said input audio signals modulating a second sub-carrier of angular frequency $\omega_s$ but displaced in phase, relative to the phase of said first sub-carrier, by 90°, a four-element diagonal difference signal representing a difference between the sum of said first pair of audio signal elements and the sum of said second pair of audio signal elements single-sideband-modulating a third sub-carrier of angular frequency $2\omega_s$, an SCA signal modulating a fourth sub-carrier of angular frequency $\omega_{sca}$ located in the spectrum space of the missing sideband of said third sub-carrier; and a pilot signal having an angular frequency $\omega_s/2$ and a phase which is such that the phase of the second harmonic thereof is effectively displaced, relative to the phase of said first sub-carrier, by 45°, said receiver comprising:

means for demodulating said composite signal from said RF carrier;

decoding means receiving said composite signal and responsive to said pilot signal for developing predetermined demodulation components corresponding to the modulation components of said composite stereo signal, including; a four-element sum component, first and second quadrature components derived from said first and second sub-carriers, and a four-element diagonal difference component derived from said third sub-carrier; and means for combining said demodulation components and said four-element sum component of said composite stereo signal to produce four discrete output audio signals suitable for synthesizing an acoustic image.

13. A four-channel stereo receiver for developing four discrete audio signals from a transmitted composite stereo signal frequency-modulating an RF carrier which effectively includes in the frequency domain at least the following components;

a four-element sum component representing the sum of four input audio signals which signals are representative of first, second, third and fourth audio sources located at the left-front, right-front, left-rear and right-rear of a listening point, a first two-element difference component representing a difference between the elements of a diagonally related first pair of said input audio signals modulating a first sub-carrier of angular frequency $\omega_s$, a second two-element difference component representing a difference between the elements of a diagonally related second pair of said input audio signals modulating a second sub-carrier of angular frequency $\omega_s$ but displaced in phase, relative to the phase of said first sub-carrier, by 90°, a four-element diagonal difference component representing a difference between the sum of said first pair of audio signal elements and the sum of said second pair of audio signal elements single-sideband-modulating a third sub-carrier of angular frequency $2\omega_s$, an SCA signal modulating a fourth sub-carrier of angular frequency $\omega_{sca}$ located in the spectrum space of the missing sideband of said third sub-carrier, and a pilot signal having an angular frequency $\omega_s/2$ and a phase which is such that the phase of the second harmonic thereof is effectively displaced, relative to the phase of said first sub-carrier by 45°, said receiver comprising:

means for demodulating said composite signal from said RF carrier;

decoding means receiving said composite signal and responsive to said pilot signal for developing predetermined frequency-domain demodulation components related to the modulation components of said composite stereo signal, comprising: means for developing from said pilot signal first and second reference carriers each having an angular frequency $\omega_s$; first and second sub-carrier demodulating means receiving said first and second reference carriers for deriving first and second demodulation components in quadrature from said first and second sub-carriers; means for developing from said pilot signal a third reference carrier of angular frequency $2\omega_s$; and a third sub-carrier demodulating means receiving said third reference carrier for deriving from said modulated third sub-carrier a demodulation component; and means for combining said demodulation components and said four-element sum component of said composite stereo signal to produce four discrete output audio signals related to said four input audio signals.

14. A receiver of the type defined by claim 13 wherein said decoding means includes band-stop filter means for filtering out said SCA signal, and means for adjusting the relative phase of said first, second and third reference carriers supplied respectively to said first, second and third sub-carriers so as to compensate for phase distortions which may be introduced in the received composite stereo signal by said band-stop filter means.

15. A method of four-channel stereo communication, comprising:

developing four input audio signals individually representative of first, second, third and fourth audio sources located, respectively, at the left-front, right-front, left-rear and right-rear of a listening point and characterizing an acoustic image;

combining said four input audio signals so as to develop a composite four-channel stereo signal including in the frequency domain at least the following components;

a four-element sum component representing the sum of said four input audio signals, a first two-element difference component representing a difference between the elements of a diagonally related first pair of said input audio signals modulating a first sub-carrier of angular frequency $\omega_s$, a second two-element difference component representing a difference between the elements of a diagonally related second pair of said input audio signals modulating a second sub-carrier of angular frequency $\omega_s$ but displaced in phase, relative to the phase of said first sub-carrier, by 90°, a four-element diagonal difference component representing a difference between the sum of said first pair of audio signal elements and the sum of said second pair of audio signal elements modulating a third sub-carrier of angular frequency $2\omega_s$, and a Hilbert transform of said four-element difference component modulating a fourth sub-carrier of angular frequency $2\omega_s$ in quadrature with said third sub-carrier which in combination with said modulated third sub-carrier effectively cancels the lower sideband of said third and fourth sub-carriers;

generating a pilot signal of frequency $\omega_s/2$ the second harmonic of which is caused to have a phase which is effectively displaced in phase, relative to the phase of said first sub-carrier, by 45°;

frequency modulating an RF carrier with said composite stereo signal and said pilot signal;

transmitting said RF carrier;

receiving and demodulating said RF carrier to derive said composite stereo signal and said pilot signal;

utilizing said pilot signal for decoding said composite signal to effectively remove from said first and second sub-carriers, respectively, first and second demodulation components disposed in quadrature and related to said first and second two-element difference components and to effectively remove from said third and fourth sub-carriers, respectively, third and fourth demodulation components also disposed in quadrature, said third demodulation component comprising said four-element diagonal difference component and said fourth demodulation component comprising a Hilbert transform of said four-element difference component;

matrixing said first, second and third demodulation components derived by said decoding process and said sum component of said composite signal to produce four modified demodulation components adapted for subsequent signal separation matrixing with said fourth demodulation component;

producing a first predetermined phase-vs-frequency characteristic of said four modified demodulation components over a predetermined band of audio frequencies;

producing a second predetermined phase-vs-frequency characteristic of said fourth demodulation component over said predetermined band to introduce a substantially 90° phase shift of said fourth demodulation component relative to said four modified demodulation components over said predetermined band; and combining said phase shifted four modified demodulation components and said phase shifted fourth demodulation component so as to produce four discrete output audio signals corresponding to said four input audio signals.

16. Apparatus for accepting four input audio signals individually representative of first, second, third and fourth audio sources located, respectively, at the left-front, right-front, left-rear and right-rear of a listening point and characterizing an acoustic image and for developing from said audio signals a composite four-channel stereo signal which is compatible with monaural and two-channel stereo receivers, comprising:

encoding means for combining said four input audio signals to develop a stereo signal effectively including in the frequency domain at least the following components;

a four-element sum component representing the sum of said four input audio signals, a first two-element difference component representing a difference between the elements of a diagonally related first pair of said input audio signals modulating a first sub-carrier of angular frequency $\omega_s$, a second two-element difference component representing a difference between the elements of a diagonally related second pair of said input audio signals modulating a second sub-carrier of frequency $\omega_s$ but displaced in phase, relative to the phase of said first sub-carrier, by 90°, and a four-element diagonal difference component representing a difference between the sum of said first pair of audio signal elements and the sum of said second pair of audio signal elements single sideband modulating a third sub-carrier of angular frequency $2\omega_s$; and means for developing a pilot signal having an angular frequency $\omega_s/2$ and a phase which is such that the phase of the second harmonic thereof is effectively displaced in phase relative to the phase of said first sub-carrier, by 45°.

17. Apparatus for accepting four input audio signals representative of first, second, third and fourth audio sources located at the left-front, right-front, left-rear and right-rear of a listening point and characterizing an acoustic image and for developing from said signals a composite four-channel stereo signal which is compatible with monaural and two-channel stereo receivers, comprising:

encoding means for combining said four input audio signals to develop a stereo signal effectively including in the frequency domain at least the following components;

a four-element sum component representing the sum of said four input audio signals, a first two-element difference component representing a difference between the elements of a diagonally related first pair of said input audio signals modulating a first sub-carrier of angular frequency $\omega_s$, a second two-element difference component representing a difference between the elements of a diagonally related second pair of input audio signals modulating a second sub-carrier of angular frequency $\omega_s$ but displaced in phase, relative to the phase of said first sub-carrier, by 90°, and a four-element diagonal difference component representing a difference between the sum of said first pair of audio signal elements and the sum of said second pair of audio signal elements modulating a third sub-carrier of angular frequency $2\omega_s$;

first phasing means for effecting a first predetermined predetermined characteristic of said stereo signal components over a predezermined band of frequencies;

means responsive to said four input audio signals for developing an auxiliary four-element diagonal difference signal corresponding to said four-element diagonal difference signal component of said stereo signal;

second phasing means receiving said auxiliary diagonal difference signal for impressing thereon a second predetermined phase-vs-frequency characteristic effective to introduce a substantially 90° phase shift of said auxiliary diagonal difference signal, relative to said four-element diagonal difference component, over said predetermined frequency band;

means for impressing said auxiliary difference signal upon an auxiliary sub-carrier of angular frequency $2\omega_s$ which is phase-displaced in a predetermined direction by 90° from said third sub-carrier modulated by said four-element diagonal difference component of said stereo signal;

means for combining said auxiliary sub-carrier modulated by said auxiliary four-element difference signal with said stereo signal to produce a modified stereo signal in which a selected one of the sidebands of said third sub-carrier is cancelled;

means for developing a pilot signal having an angular frequency $\omega_s/2$ the second harmonic of which is effectively displaced, in phase, relative to the phase of said first sub-carrier, by 45°; and means for combining said modified stereo signal and said pilot signal to produce a composite four channel stereo signal.

18. A method for processing four input audio signals representative of first, second, third and fourth audio sources located at the left-front, right-front, left-rear and right-rear of a listening point and characterizing an acoustic image to develop a composite four-channel stereo signal which is compatible with monaural and two-channel stereo receivers, said method comprising:

impressing on said four input audio signals, over a predetermined band of audio frequencies, a predetermined first phase-vs-frequency characteristic;

combining said four input audio signals to develop a stereo signal effectively including in the frequency domain at least the following components;

a four-element sum component representing the sum of said four input audio signals, a first two-element difference component representing a difference between the elements of a diagonally related first pair of said input audio signals modulating a first sub-carrier of angular frequency $\omega_s$, a second two-element difference component representing a difference between the elements of the diagonally related second pair of input audio signals modulating a second sub-carrier of angular frequency $\omega_s$ but displaced in phase, relative to the phase of said first sub-carrier, by 90°, and a four-element diagonal difference component representing a difference between the sum of said first pair of audio signal elements and the sum of said second pair of audio signal elements modulating a third sub-carrier of angular frequency $2\omega_s$;

developing from said four input audio signals an auxiliary four-element diagonal difference signal corresponding to said four-element diagonal difference signal component of said stereo signal;

impressing upon said auxiliary difference signal a predetermined second phase-vs-frequency characteristic effective to introduce over said predetermined band of frequencies a substantially 90° phase shift of said auxiliary difference signal relative to said four-element difference component;

impressing said auxiliary difference signal upon an auxiliary carrier of angular frequency $2\omega_s$ which is phase displaced by 90° from said third sub-carrier carrying said four-element difference component of said stereo signal;

combining said auxiliary carrier modulated by said auxiliary difference signal with said stereo signal to produce a modified stereo in which a selected one of the sidebands of said third sub-carrier is removed;

developing a pilot signal having an angular frequency $\omega_s/2$ and a phase which is such that the phase of the second harmonic thereof is effectively displaced, relative to the phase of said first sub-carrier component by 45°; and combining said modified stereo signal and said pilot signal to form a composite four channel stereo signal.

19. A four-channel stereo receiver for developing four discrete audio signals from a transmitted composite stereo signal frequency-modulating an RF carrier which effectively includes in the frequency domain at least the following components:

a four-element sum component representing the sum of four input audio signals which signals are representative of first, second, third and fourth audio sources located at the left-front, right-front, left-rear and right-rear of a listening point, a first two-element difference component representing a difference between the elements of a diagonally related first pair of said input audio signals modulating a first sub-carrier of angular frequency $\omega_s$, a second two-element difference component representing a difference between the elements of a diagonally related second pair of said input audio signals modulating a second sub-carrier of angular frequency $\omega_s$ but displaced in phase, relative to the phase of said first sub-carrier, by 90°, a four-element diagonal difference signal representing a difference between the sum of said first pair of audio signal elements and the sum of said second pair of audio signal elements modulating a third subcarrier of angular frequency $2\omega_s$;

and a pilot signal having an angular frequency $\omega_s/2$ and a phase which is such that the phase of the second harmonic thereof is effectively displaced, relative to the phase of said first subcarrier, by 45°, said receiver comprising:

means for demodulating said composite signal from said RF carrier;

decoding means responsive to said composite signal and to said pilot signal for developing predetermined demodulation components corresponding to the modulation components of said composite stereo signal, said decoding means comprising:

a first product detector for deriving said first two-element difference component from said first sub-carrier, a second product detector for deriving said second two-element difference component from said second sub-carrier, a third product detector for deriving a negative of said first two-element difference component from a sub-carrier of like frequency but 180° phase shifted with respect to said first sub-carrier, a fourth product detector for deriving a negative of said second two-element difference component from a sub-carrier of like frequency but 180° phase shifted with respect to said second subcarrier;

first gating means responsive to said composite signal and to said third subcarrier for deriving a first two-element sum component;

second gating means responsive to said composite signal and to a sub-carrier 180° phase shifted from said third sub-carrier for deriving a second two-element sum component; and matrix means for combining the four of said two-element difference components and the two of said two-element sum components to produce four discrete output audio signals.

20. A receiver as set forth in claim 19 in which each of said first and second gating means includes means for translating said four-element sum component from the input of each said gating means to its output in unmodified form and for demodulating said third sub-carrier to provide said first and second two-element sum components.

21. A receiver as set forth in claim 19 in which said first and third product detectors comprise a first double-balanced demodulator and in which said second and fourth product detectors comprise a second double-balanced demodulator.

22. A receiver as set forth in claim 21 in which each of said product detectors comprises a pair of gates with one input terminal of each gate being driven by said composite signal.

23. A receiver as set forth in claim 22 in which each of said gates comprises a transistor and said one input terminal of each said gate comprises an emitter electrode.

24. A receiver as set forth in claim 19 in which said first and third product detectors collectively comprise a pair of switches driven by a differential amplifier; and said second and fourth product detectors collectively comprise a pair of switches driven by a second differential amplifier.

* * * * *